US010409186B2

(12) United States Patent
Hotta et al.

(10) Patent No.: US 10,409,186 B2
(45) Date of Patent: Sep. 10, 2019

(54) TONER AND IMAGE FORMING METHOD

(71) Applicant: CANON KABUSHIKI KAISHA, Tokyo (JP)

(72) Inventors: Yojiro Hotta, Mishima (JP); Shohei Tsuda, Suntou-gun (JP); Taiji Katsura, Suntou-gun (JP); Masaharu Miura, Toride (JP); Yoshinobu Baba, Yokohama (JP); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/908,938

(22) PCT Filed: Jul. 30, 2014

(86) PCT No.: PCT/JP2014/070660
§ 371 (c)(1),
(2) Date: Jan. 29, 2016

(87) PCT Pub. No.: WO2015/016385
PCT Pub. Date: Feb. 5, 2015

(65) Prior Publication Data

US 2016/0202621 A1 Jul. 14, 2016

(30) Foreign Application Priority Data

Jul. 31, 2013 (JP) ..... 2013-159302

(51) Int. Cl.
*G03G 9/097* (2006.01)
*G03G 15/22* (2006.01)
(Continued)

(52) U.S. Cl.
CPC ..... *G03G 9/09725* (2013.01); *G03G 9/0823* (2013.01); *G03G 9/0827* (2013.01);
(Continued)

(58) Field of Classification Search
CPC ..... G03G 9/09708; G03G 9/09725; G03G 9/09733
See application file for complete search history.

(56) References Cited

U.S. PATENT DOCUMENTS

2010/0092208 A1* 4/2010 Ogaki ..... G03G 5/056 399/111
2011/0053073 A1* 3/2011 Isono ..... G03G 9/0806 430/108.3
2011/0294056 A1* 12/2011 Magome ..... G03G 9/0833 430/106.2

FOREIGN PATENT DOCUMENTS

JP 2000089508 A 3/2000
JP 2000122341 A 4/2000
(Continued)

OTHER PUBLICATIONS

Translation of JP 2011-090168.*

*Primary Examiner* — Peter L Vajda
(74) *Attorney, Agent, or Firm* — Canon U.S.A. Inc., IP Division

(57) ABSTRACT

A toner is provided, where good cleanability is exhibited, abrasion variations of the photo conductor surface is reduced, and contamination of a charge member is reduced. The toner includes toner particles and organic-inorganic composite fine particles on the toner particle surfaces, wherein each of the organic-inorganic composite fine particles is a particle in which inorganic fine particles are exposed at the surfaces of vinyl based resin particles in such a way that convex portions derived from the inorganic fine particles are formed on the surfaces, the average circularity of the toner is 0.960 or more, and the absolute value Q of the amount of triboelectricity of the toner measured by a two-component method and the electrostatic adhesion F of the toner satisfy $0.003 \leq F/Q^2 \leq 0.040$.

9 Claims, 3 Drawing Sheets

(51) Int. Cl.
*G03G 9/08* (2006.01)
*G03G 15/08* (2006.01)

(52) U.S. Cl.
CPC ..... *G03G 9/09708* (2013.01); *G03G 9/09716* (2013.01); *G03G 15/22* (2013.01); *G03G 15/08* (2013.01)

(56) References Cited

FOREIGN PATENT DOCUMENTS

| | | | | | |
|---|---|---|---|---|---|
| JP | 2000347462 | A | | 12/2000 | |
| JP | 2002318467 | A | | 10/2002 | |
| JP | 2003005514 | A | | 1/2003 | |
| JP | 2004252147 | A | | 9/2004 | |
| JP | 2006195079 | A | | 7/2006 | |
| JP | 2009014881 | A | | 1/2009 | |
| JP | 2011-090168 | | * | 6/2011 | ..... G03G 9/08 |
| JP | 2012013776 | A | | 1/2012 | |
| JP | 2012068325 | A | | 4/2012 | |
| JP | 2013083837 | A | | 5/2013 | |
| JP | 2013092748 | A | | 5/2013 | |
| WO | 2010008095 | A1 | | 1/2010 | |
| WO | 2013063291 | A1 | | 5/2013 | |
| WO | WO 2013/063291 | | * | 5/2013 | ..... G03G 9/097 |

* cited by examiner

TONER AND IMAGE FORMING METHOD

TECHNICAL FIELD

The present invention relates to a toner used for an image forming method to develop an electrophotograph or an electrostatic charge image and an image forming method.

BACKGROUND ART

As for a general electrographic method, a method for obtaining a copied material by forming a latent image on an image bearing member (photosensitive drum), visualizing the latent image by supplying a toner to the latent image, transferring the resulting toner image to a transfer material, e.g., paper, and thereafter, fixing the toner image on the transfer material by heat/pressure is known.

For example, in the electrophotography, a photo conductor-shaped drum, which serves as a photosensitive drum, through the use of a photoconductive substance is subjected to a charging treatment uniformly to have predetermined polarity and potential and is subjected to image pattern exposure, so that an electrostatic latent image is formed. Thereafter, development is performed with a toner and the resulting image is transferred and fixed to a transfer medium, e.g., paper, in general. After the transfer step, the toner remaining on the photosensitive drum is removed by some method. Blade cleaning is mentioned as a removal method employed most frequently. This is a method to scrape the toner by pressing a blade-shaped member, e.g., rubber, having elasticity against a photosensitive drum surface.

A spherical toner having a sharp particle size distribution and serving as the toner used for such an electrophotograph has characteristics, e.g., excellent transferability and thin line reproducibility. On the other hand, in a system to clear the toner from the photosensitive drum, cleaning becomes difficult as the circularity increases. One of the reasons is considered to be that rolling of the toner occurs because of high circularity and the toner slips through a contact nip between the cleaning blade and the photo conductor easily.

As for a measure to prevent poor cleaning with respect to the spherical toner, for example, in a cleaning apparatus of a blade system, it has been attempted to prevent slipping through of the spherical toner by increasing the linear pressure applied to an edge portion of a blade. However, this measure on the basis of merely an increase in linear pressure has problems that, for example, chipping of a blade edge portion is facilitated, an unusual sound occurs because of chatter vibrations, or abrasion of the photo conductor due to contact of a blade is facilitated.

PTL 1 proposes a method in which an external additive is retained on an blade edge portion to form an inhibition layer and, thereby, toner particles are blocked to stabilize cleaning. According to this method, the external additive to form the inhibition layer slip through the blade, so that a charge member is contaminated. Consequently, it is necessary that a mechanism to clean the charge member be disposed, the mechanism becomes complicated, and an increase in the cost is caused.

PTL 2 proposes a measure to reduce a toner remaining after transfer and improve cleanability through reduction in the adhesion by embedding an external additive into a spherical toner. However, it is difficult to obtain sufficient cleanability of the toner with high circularity.

CITATION LIST

Patent Literature

PTL 1 Japanese Patent Laid-Open No. 2002-318467
PTL 2 Japanese Patent Laid-Open No. 2012-68325
PTL 3 WO 2013/063291
PTL 4 Japanese Patent Laid-Open No. 2013-92748
PTL 5 WO 2010/008095

Non Patent Literature

NPL 1 Ricoh Technical Report, No. 26 (2,000)
NPL 2 KONICA MINOLTA TECHNOLOGY REPORT VOL 1 (2004)

SUMMARY OF INVENTION

High circularity of the toner causes poor cleaning easily. The cleanability is improved by increasing the contact pressure of the cleaning blade. However, chipping of a blade, abrasion of the photo conductor, and unusual sounds because of chatter vibrations of the blade occur easily.

A method in which entry of the toner is prevented by isolating a previously known external additive to form an inhibition layer is mentioned. However, there is an issue that the external additive to form the inhibition layer slips through the blade and a charge member is contaminated.

The present invention provides a toner and an image forming method.

That is, good cleanability is exhibited, abrasion variations of the photo conductor surface are reduced, and contamination of a charge member is reduced.

The present invention relates a toner comprising:

toner particles; and organic-inorganic composite fine particles, each of which comprises a vinyl based resin particle and inorganic fine particles, wherein:

the inorganic fine particles are exposed at surfaces of the organic-inorganic composite fine particles, each of the organic-inorganic composite fine particles has convex portions derived from the inorganic fine particles on the surfaces thereof, and an abundance ratio of the inorganic fine particles exposed at the surface of the organic-inorganic fine particles ranges from 20% to 70%, and wherein:

the toner has an average circularity of 0.960 or more, and satisfies the following condition:

$$0.003 \leq F/Q^2 \leq 0.040$$

wherein Q (mC/kg) represents the absolute value of the amount of triboelectricity of the toner measured by a two-component method, and F (nN) represents the electrostatic adhesion of the toner to a polycarbonate flat plate.

Further features of the present invention will become apparent from the following description of exemplary embodiments with reference to the attached drawings.

DESCRIPTION OF EMBODIMENTS

Figure 1:
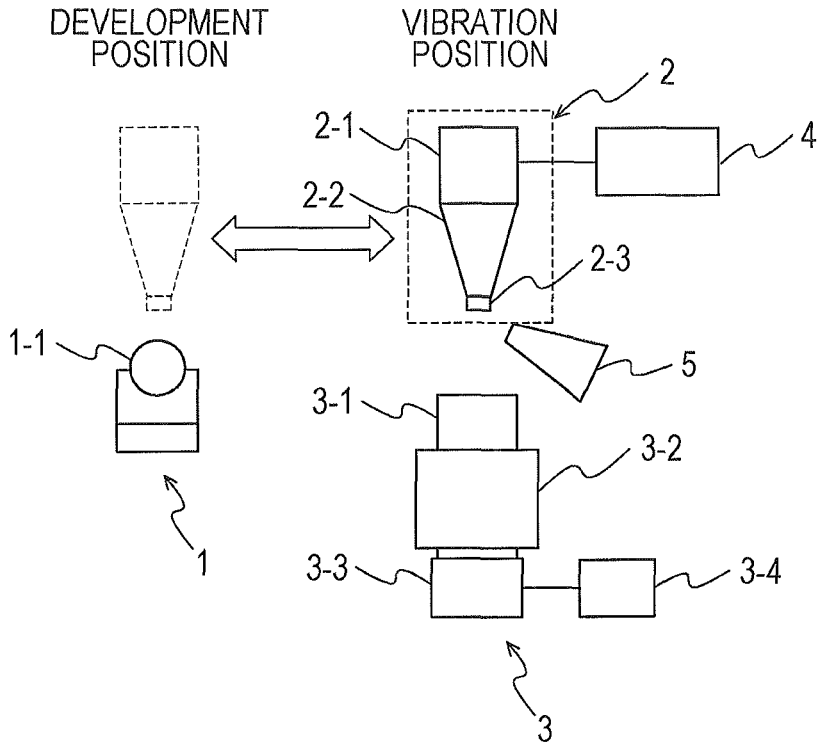
FIG. 1 is an explanatory diagram of an apparatus to measure the electrostatic adhesion, used in the present invention.

The configuration of the present invention is as described below.

A toner including toner particles and organic-inorganic composite fine particles on the toner particle surfaces is provided, wherein each of the organic-inorganic composite fine particles is a particle in which inorganic fine particles are exposed at the surfaces of vinyl based resin particles in such a way that convex portions derived from the inorganic fine particles are formed on the surfaces and the abundance ratio of the inorganic fine particles on surfaces of the organic-inorganic composite fine particle is 20% or more and 70% or less, the average circularity of the toner is 0.960 or more, and the toner satisfies the following condition $$0.003 \leq F/Q^2 \leq 0.040$$

where the absolute value of the amount of triboelectricity of the toner measured by a two-component method is specified to be Q (mC/kg) and the electrostatic adhesion of the toner to a polycarbonate flat plate is specified to be F (nN).

A spherical toner exhibits reduced surface unevenness and, therefore, variations in the contact state between toner particles and a photosensitive drum are reduced and excellent transferability is exhibited. In addition, variations in attachment of an external additive are reduced and chargeability is excellent. On the other hand, there is an issue that the spherical toner rolls easily, so as to enter a cleaning nip portion easily and, thereby, slip through the cleaning nip portion easily.

Good cleaning has been made possible previously by increasing the contact pressure of the cleaning blade with the photosensitive drum to establish a configuration in such a way that the toner does not enter easily. However, if the contact pressure of the cleaning blade is increased, new issues occur. For example, the photosensitive drum is abraded easily, so that the life is reduced and blade burr occurs easily depending on the output mode of an image and the use environment. Consequently, it is necessary to research a spherical toner exhibiting good cleanability even when the contact pressure of the cleaning blade is decreased.

Then, formation of an inhibition layer by using an external additive having a large particle diameter, as described in PTL 1, was studied. Examples of previously generally used large particle diameter external additives include large particle diameter external additives, e.g., sol-gel silica, having a spherical shape and a sharp particle size distribution. However, when the surface of the external additive was a single composition of silica, the electrostatic adhesion to the photosensitive drum was high and the effect on the cleanability with respect to the spherical toner was insufficient. In order to clean the spherical toner, a stronger inhibition layer is necessary. However, a spherical external additive contaminates a charging member because the external additive slips through a blade.

The present inventors examined the cleanability of the spherical toner. As a result, it was found that use of organic-inorganic composite fine particles composed of a vinyl based resin and inorganic fine particles as the external additive was effective. Explanations will be made below in detail.

The organic-inorganic composite fine particle according to the present invention refers to a particle in which a base particle is an organic compound and inorganic fine particles are present on the surface thereof. Moreover, inorganic fine particles may be embedded in the base particle. In addition, there is a feature that convex portions derived from inorganic fine particles are present on the organic-inorganic composite fine particle surface. The organic-inorganic composite fine particle shows the form similar to the form of the silica-polymer particle reported in, for example, Imaging Conference JAPAN 2012. According to the contents reported here, the silica-polymer particle has features that the specific gravity is small and detachment from a toner particle is reduced because of many contact points due to unevenness of the surface while chargeability and fluidity equivalent to those of colloidal silica are exhibited. Consequently, it is reported that a spacer effect and blocking resistance are exhibited on a small-particle diameter or low-melting point toner more effectively. The same silica-polymer particle is also disclosed in PTL 3 and PTL 4.

In order to clean the spherical toner, it is necessary that not only the inhibition layer but also the electrostatic adhesion be taken into consideration. In the cleaning step, reduction in the electrostatic adhesion of the toner is required because scraping of a toner remaining after transfer, which has electrostatically adhered to the photosensitive drum surface, is necessary. For example, in NPL 1, it is estimated that the electrostatic adhesion of the toner is influenced by the charge distribution on the toner surface due to the external additive. In particular, the toner surface of the spherical toner is smooth and, therefore, the electrostatic adhesion is influenced by the state of the external additive easily.

As for the method for measuring the electrostatic adhesion, a vibration type electrostatic adhesion measuring apparatus reported in NPL 2 and Dai 1 kai Gazou Keisei Gijutsu ni kansuru Kenkyuukai (The 1st Society for the Study of Image Forming Technology) (2012) was used. The outline of the apparatus was as described below. A toner mixed with a magnetic carrier and friction-charged was developed on a sample stage by a two-component development system and was allowed to electrostatically adhere. A sample stage coated with polycarbonate, which was used on a photosensitive drum surface, was used as the sample stage. The sample stage was mounted on a vibration unit in which an amplitude amplification horn was connected to a piezoelectric vibrator, and the vibrator was vibrated to impart vibration acceleration to the toner. The vibration acceleration from 0 to 2 $Mm/sec^2$ was imparted in 24 fractions. The manner of detachment of the toner from a sample electrode was observed with CCD, and the vibration acceleration, at which 50% of toner in the initial state was detached on an area ratio basis, was calculated.

The force of inertia applied to the toner is represented by $F=mA\omega^2$, where the vibration amplitude is specified to be A, the vibration angular velocity of the vibrator is specified to be $\omega$, and the mass of toner is specified to be m. The gravity applied to the toner is sufficiently smaller relative to the adhesion and, therefore, can be neglected. The force of inertia when the toner is detached is equal to the adhesion of the toner. Therefore, calculation was performed on the basis of the above-described formula. At this time, the mass m of the toner is calculated from the number average particle diameter r of the toner and the true density ρ of the toner on the basis of $m=\pi/6\times r^3\times\rho$.

Measurement of Electrostatic Adhesion Method for Preparing Developing Agent and Method for Measuring Amount of Triboelectricity (Two-Component Method)

A magnetic carrier (Standard carrier N-01 produced by the Image Society of Japan) and a toner were weighed into a 50-mL polymer container in such a way that the total amount was 5.0 g, and humidity conditioning was performed for 24 hours under an ambient temperature and normal humidity environment (23° C., 60%) while the magnetic carrier and the toner were stacked. After the humidity conditioning, the cap of the polymer bottle was closed, and rotation was performed with a roll mill by 15 turns at a rate of 1 revolution per second. Subsequently, the sample was attached to a shaker on a polymer bottle basis, and a developing agent for measurement was prepared by performing shaking at 150 strokes per minute for 5 minutes to mix the toner and the magnetic carrier. The developing agent was formed by performing this operation in such a way that the percentage by mass of the toner relative to the total amount of the developing agent became 3 percent by mass, 5 percent by mass, or 7 percent by mass (for example, in the case of 3 percent by mass, the magnetic carrier was 4.85 g and the toner was 0.15 g).

Suction-type Tribo-charge Measuring System Sepasoft Model STC-1-C1 (produced by SANKYO PIO-TECH CO., Ltd.) was used as an apparatus to measure the amount of triboelectricity. A mesh (metal gauge) having an aperture of 20 μm was placed on the bottom of a sample holder (Faraday cage), 0.20 g of developing agent was put thereon, and the cap was closed. The mass of the whole sample holder at this time was weighed and was specified to be W1 (g). Then, the sample holder was installed in the main body, and the suction pressure was specified to be 6 kPa by adjusting an air volume control valve. The toner was removed by suction for 1 minute in this state. The charge at this time was specified to be q (mC). The mass of the whole sample holder after suction was measured and was specified to be W2 (g). The polarity of the amount of triboelectricity of the toner is reverse to the q determined here because the charge of the carrier is measured. The absolute value of the amount of triboelectricity Q (mC/kg) of the developing agent is calculated on the basis of the formula described below. In this regard, the measurement was also performed under the ambient temperature and normal humidity environment (23° C., 60%).

$$\text{amount of triboelectricity } Q\ (\text{mC/kg})=q/(W1-W2)$$

Method for Measuring Electrostatic Adhesion

The outline of a measuring apparatus is as shown in FIG. 1. A development sleeve 1-1 was coated with the developing agent formed by the above-described method by putting 3 g of developing agent into a development unit 1 and rotating the sleeve 1-1. At this time, the developing agent applied to the sleeve 1-1 was visually checked and in the case where adjustment of the amount of coating was necessary, the adjustment was performed by the distance between the development blade (not shown in the drawing) included in the development unit and the sleeve 1-1.

A vibration unit 2 was composed of a vibrator 2-1, a horn 2-2, and a sample stage 2-3. A thin film of a polycarbonate resin (bisphenol Z type, trade name: Iupilon Z200, produced by Mitsubishi Gas Chemical Company, Inc.) was bonded to the surface of the sample stage 2-3. This vibration unit 2 was moved in such a way as to pass above the sleeve 1-1 (development position) while the development sleeve 1-1 was rotated. In the time of passing, the rotation speed of the sleeve 1-1 was specified to be 0.1 m/sec and the movement speed of the vibration unit 2 was specified to be 0.001 m/sec. When the vibration unit 2 was passed above the sleeve 1-1, a voltage was applied between the sleeve 1-1 and the sample stage 2-3 to develop (fly) the toner on the sample stage 2-3. The electric field strength at this time was able to be adjusted by the voltage applied between the sleeve 1-1 and the sample stage 2-3 or the gap therebetween in accordance with the amount of triboelectricity and the like of the toner. The guideline of the electric field strength was 0.5 V/m.

After the toner was developed on the sample stage 2-3, the vibration unit 2 was moved to the vibration position, and the state of adhesion of the toner was examined with CCD 3-3 provided with an objective lens 3-1 and a lens barrel 3-2. The lens 3-1 and CCD 3-3 were selected in such a way that the performance of a detection portion 3 exhibited a resolving power of 0.22 μm and the field of view was 570 μm×427 μm. The state of adhesion of the toner was specified to be in the state in which one to two toner layers were stacked in the whole field of view. As for the method for discriminating the states, after the toner was developed, it was ascertained on the basis of the image from the detection portion 3 that toner particles were present in the whole field of view as compared with the state before the development.

After the toner was allowed to adhere to the sample stage 2-3, the sample stage 2-3 was vibrated with the vibrator 2-1. Amplification was performed through the vibrator 2-1 and the horn 2-2 from an oscillator 4 and, thereby, the sample stage 2-3 was vibrated. The vibration acceleration ($=A\omega^2$) from 0 to $2\times10^6$ m/sec$^2$ was divided into 24 fractions and was configured to be able to vibrate the sample stage 2-3 discontinuously. The toner detached from the sample stage 2-3 was collected by being suctioned with a vacuum-cleaner 5 during vibration. The state of adhesion of the toner was in synchronization with the state of being captured from CCD 3-3 into a personal computer 3-4 after the vibration acceleration was imparted to the sample stage 2-3. After the vibration acceleration was imparted up to $2\times10^6$ m/sec$^2$, the state of the toner was subjected to image processing with image processing software (Photoshop produced by Adobe Systems Incorporated). Specifically, when the resulting image was binarized, a portion with the toner adhered was turned black. In the state in which the vibration acceleration was not imparted, the toner was present in the whole field of view and, therefore, the area ratio of the portion turned black became a value close to 100%. In the case where the vibration acceleration increased from that, the toner was detached from the sample stage 2-3 at some vibration acceleration, and the area ratio of the portion turned black decreased. In the present invention, the force of inertia (=electrostatic adhesion) of the toner was determined from the vibration acceleration which was imparted when the area ratio became 50%.

In the present invention, the amount of triboelectricity and the electrostatic adhesion of each of the three samples in which the proportion of the toner relative to the magnetic carrier were changed (3 percent by mass, 5 percent by mass, and 7 percent by mass), as described above, were measured. The resulting amount of triboelectricity $Q^2$ and electrostatic adhesion F were plotted and $F/Q^2$ was determined from a linear approximate expression thereof.

In order to improve the cleanability of a spherical toner, it is necessary that the toner satisfies $$0.003\leq F/Q^2\leq 0.040$$

where the absolute value of the amount of triboelectricity of the toner by a two-component method is specified to be Q (mC/kg) and the electrostatic adhesion of the toner to a polycarbonate flat plate is specified to be F (nN). If $F/Q^2$ is smaller than 0.003, the electrostatic adhesion of the toner is too small, so that the toner is not supported by the photosensitive drum easily and image defects occur in transfer. If $F/Q^2$ is larger than 0.040, the cleanability is degraded. More preferably, $$0.010 \leq F/Q^2 \leq 0.035$$

is satisfied.

The electrostatic adhesion of the toner is preferably 50 nN or more and 200 nN or less when the value of $Q^2$ of the toner is 4,000 $(mC/kg)^2$. If the electrostatic adhesion is smaller than 50 nN, an image is disturbed easily in the transfer, and the thin line reproducibility is degraded. If the electrostatic adhesion is larger than 200 nN, the electrostatic adhesion to the photosensitive drum increases and poor cleaning occurs easily. The electrostatic adhesion of the toner is more preferably 50 nN or more and 150 nN or less.

It is necessary that the abundance ratio of the inorganic fine particles on surfaces of the organic-inorganic composite fine particle be 20% or more and 70% or less. If the abundance ratio of the inorganic fine particles on the organic-inorganic composite fine particle surfaces is less than 20%, convex portions derived from the inorganic fine particles are reduced and slipping occurs through the cleaning blade and a charge member is contaminated. If the abundance ratio is more than 70%, the electrostatic adhesion increases and the cleanability is degraded. The abundance ratio of the inorganic fine particles is more preferably 30% or more and 60% or less.

The organic-inorganic composite fine particles according to the present invention may be produced by the method described in PTL 3. Examples of other methods include a manufacturing method, in which organic-inorganic composite fine particles are produced by implanting inorganic particles into resin particles afterward, and a manufacturing method, in which organic-inorganic composite fine particles are produced by dispersing inorganic particles and dissolved resin in a solution.

In the case where organic-inorganic composite fine particles are produced by implanting inorganic particles into resin particles afterward, organic resin particles are produced initially. Examples of methods for producing the resin particles include a method in which a resin is made into fine particles by being freeze crushed, a method in which fine particles are obtained by emulsifying and suspending a dissolved resin in a solution, and a method in which resin particles are obtained by polymerizing, e.g., emulsion polarizing or suspension polarizing, the monomer of the resin component.

The method for implanting inorganic particles into organic resin particles may use Hybridizer (produced by NARA MACHINERY CO., LTD.), NOBILTA (produced by Hosokawa Micron Corporation), MECHANOFUSION (produced by Hosokawa Micron Corporation), HIGH FLEX GRAL (produced by EARTHTECHNICA CO., LTD.), and the like. The organic-inorganic composite fine particles may be produced by treating the organic resin particles and the inorganic particles with these apparatuses and, thereby, fixing the inorganic particles on the organic resin particle surfaces uniformly.

As for the organic component of the organic-inorganic composite fine particle according to the present invention, monopolymers of styrene and substitution products thereof, e.g., polystyrenes and polyvinyl toluenes; styrene based copolymers, e.g., styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleic acid ester copolymers; polymethyl methacrylates, polybutyl methacrylates, polyvinyl acetates, polyethylenes, polypropylenes, polyvinyl butyrals, polyacrylic resins, polyolefin based resins, polyacrylonitriles, polyvinyl acetates, polyvinyl butyrals, polyvinyl chlorides, polyvinyl carbazoles, polyvinyl ethers, polyvinyl ketones, vinyl chloride-vinyl acetate copolymers, fluororesins, e.g., polytetrafluoroethylenes, polyvinyl fluorides, polyvinylidene fluorides, and polychlorotrifluoroethylenes, and the like can be used. They may be used alone or a plurality of types may be used in combination.

Examples of polymerizable monomers of the organic compounds include styrene based monomers, e.g., styrene, o-methyl styrene, m-methyl styrene, p-methyl styrene, p-methoxystyrene, and p-ethyl styrene, acrylic acid esters, e.g., methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate, methacrylic acid esters, e.g., methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate, and other monomers of acrylonitrile, methacrylonitrile, and acrylamide. These monomers may be used alone or in combination.

The surface of the organic inorganic-composite fine particle may be treated with an organosilicic compound or silicone oil. As for the surface treatment, the organic-inorganic composite fine particles may be subjected to the surface treatment, or the inorganic particles subjected to the surface treatment may be combined with the resin.

The organic-inorganic composite fine particles or the inorganic particles used for the organic-inorganic composite fine particles can be subjected to a chemical hydrophobic treatment with an organosilicic compound which physically adsorb them. A method in which silica fine particles generated by vapor phase oxidation of a silicon halogen compound are treated with the organosilicic compound can be employed. Examples of such organosilicic compounds include the following.

Hexamethyldisilazane, methyltrimethoxysilane, octyltrimethoxysilane, isobutyltrimethoxysilane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and dimethylpolysiloxane having 2 to 12 siloxane units per molecule, where each of the units located at ends includes one hydroxyl group bonded to Si. They may be used alone or in combination.

The organic-inorganic composite fine particles or the inorganic particles used for the organic-inorganic composite fine particles may be subjected to a silicone oil treatment or be treated in combination with the above-described hydrophobic treatment.

Silicone oils having a viscosity of 30 $mm^2/s$ or more and 1,000 $mm^2/s$ or less at 25° C. can be used. For example, in particular, dimethylsilicone oil, methylphenylsilicone oil, α-methylstyrene-modified silicone oil, chlorophenylsilicone oil, and fluorine-modified silicone oil can be employed.

Examples of methods for treating the silicone oil include a method in which silica fine particles treated with a silane coupling agent and silicone oil are directly mixed by using a mixer, e.g., a Henschel mixer, a method in which silicone oil is sprayed on silica fine particles serving as the base, and a method in which silicone oil is dissolved or dispersed into an appropriate solvent, silica fine particles are added and mixed and, thereafter, the solvent is removed can be employed in particular.

Examples of the inorganic particles of the organic-inorganic composite fine particles according to the present invention include silica, alumina, titania, zinc oxide, strontium titanate, cerium oxide, and calcium carbonate. In particular, in the case where the inorganic particles are silica, excellent chargeability is exhibited and, therefore, an effect can be exerted on the developability. Silica may be, for example, fumed silica obtained by a dry method and sol-gel silica obtained by a wet method.

The proportion of the inorganic fine particles contained in the organic-inorganic composite fine particles can be 30 percent by mass or more and 80 percent by mass or less relative to the organic-inorganic composite fine particles from the viewpoint of the production stability and the particle size distribution control.

The toner surface of a toner having a high average circularity is smooth and, therefore, an external additive rolls easily. Consequently, the external additive can be present in the state in which rolling does not occur easily in order to improve the cleanability and maintain the performance stably. Then, the organic-inorganic composite fine particles have the shape factor SF-1 of preferably 100 or more and 150 or less and the shape factor SF-2 of preferably 103 or more and 120 or less, which are measured by using a magnified image of the organic-inorganic composite fine particles photographed with a scanning electron microscope. The SF-1 is more preferably 110 or more and 140 or less.

The SF-2 is an index indicating the degree of unevenness of the surface, and if the SF-2 is less than 103, the organic-inorganic composite fine particles roll on the toner surface easily, so that the electrostatic adhesion to the photosensitive drum becomes high easily. Also, the organic-inorganic composite fine particles are not caught by the cleaning blade easily. As a result, a firm inhibition layer is not formed easily, and poor cleaning occurs easily. If the SF-2 is more than 120, catching by the cleaning blade occurs but flaws of the photosensitive drum are generated easily. The SF-2 is more preferably 105 or more and 120 or less.

The number average particle diameter (A) of the organic-inorganic composite fine particles is preferably 50 nm or more and 400 nm or less. If the number average particle diameter (A) of the organic-inorganic composite fine particles is less than 50 nm, member contamination occurs easily because of slipping through the cleaning blade. If 400 nm is exceeded, the organic-inorganic composite fine particles are isolated from the toner easily, and image defects, e.g., development streaks, occur easily. The number average particle diameter (A) is more preferably 80 nm or more and 250 nm or less, and further preferably 90 nm or more and 200 nm or less.

The amount of addition of the organic-inorganic composite fine particles is preferably 0.5 parts by mass or more and 5.0 parts by mass or less relative to 100 parts by mass of toner particles. In the above-described range, an inhibition layer is formed favorably while an occurrence of development streak is suppressed and poor cleaning is reduced favorably. The amount of addition is more preferably 0.5 parts by mass or more and 4.0 parts by mass or less relative to 100 parts by mass of the toner particles.

The toner according to the present invention can contain inorganic fine particles (second inorganic fine particles) as a second external additive. The chargeability and the fluidity are imparted by containing the inorganic fine particles. Examples of inorganic fine particles include fine particle silica, e.g., wet process silica and dry process silica, treated silica produced by subjecting the fine particle silica to a surface treatment with a silane coupling agent, a titanium coupling agent, silicone oil, or the like, and titanium oxide.

The dry process silica generated by vapor phase oxidation of a silicon halogen compound or the fumed silica can be employed from the viewpoint of charge impartment and fluidity impartment. For example, a thermal decomposition oxidation reaction of silicon tetrachloride gas in oxygen, hydrogen is utilized, where the reaction formula is as described below.

$$SiCl_4+2H_2+O_2 \rightarrow SiO_2+4HCl$$

A composite fine powder of silica and other metal oxide obtained in this production process by using other metal halogen compound, e.g., aluminum chloride or titanium chloride, together with silicon halogen compound may be employed.

Furthermore, a treated silica fine powder, which has been prepared by subjecting a silica fine powder generated by vapor-phase oxidation of the silicon halogen compound to a hydrophobic treatment, can be used. In particular, the silica fine powder can be treated in such a way that the treated silica fine powder exhibits the value of degree of hydrophobicity within the range of 30 or more and 98 or less on the basis of titration by a methanol titration test.

The hydrophobic treatment is performed by a chemical treatment with an organosilicic compound which reacts with or physically adsorbs the silica fine powder. A method in which a silica fine powder generated by vapor-phase oxidation of a silicon halogen compound is treated with an organosilicic compound can be employed. Examples of such organosilicic compounds include the following. Hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and dimethylpolysiloxane having 2 to 12 siloxane units per molecule, where each of the units located at ends includes one hydroxyl group bonded to Si. They may be used alone or in combination.

The silica fine powder may be subjected to a silicone oil treatment in order to improve the slippiness of the photo conductor or be treated in combination with the above-described hydrophobic treatment.

Silicone oils having a viscosity of 30 $mm^2/s$ or more and 1,000 $mm^2/s$ or less at 25° C. can be used. For example, in particular, dimethylsilicone oil, methylphenylsilicone oil, α-methylstyrene-modified silicone oil, chlorophenylsilicone oil, and fluorine-modified silicone oil can be employed.

Examples of methods for treating the silicone oil include a method in which a silica fine powder treated with a silane coupling agent and silicone oil are directly mixed by using a mixer, e.g., a Henschel mixer, a method in which silicone oil is sprayed on the silica fine powder serving as the base, and a method in which silicone oil is dissolved or dispersed into an appropriate solvent, silica fine particles are added and mixed and, thereafter, the solvent is removed. In particular, after the treatment with the silicone oil, the coating on the surface of the silicone oil-treated silica can be stabilized by heating the silica in an inert gas at a temperature of 200° C. or higher (more preferably 250° C. or higher).

As for the silane coupling agent, hexamethyldisilazane (HMDS) can be mentioned.

In the present invention, those treated by a method in which silica is treated with a coupling agent in advance and is treated with silicone oil or a method in which silica is treated with a coupling agent and silicone oil at the same time can be employed.

The usage of the inorganic fine particles is preferably 0.01 parts by mass or more and 5.00 parts by mass or less relative to 100.00 parts by mass of the toner particles, and more preferably 0.10 parts by mass or more and 3.00 parts by mass or less.

As for the inorganic fine particles serving as the second external additive, the ratio (A/B) is preferably 1.5 or more and 10.0 or less, where the number average particle diameter of the organic-inorganic composite fine particles is specified to be A (nm) and the number average particle diameter of the inorganic fine particles is specified to be B (nm). In the case where the ratio (A/B) of the number average particle diameter (A) to the number average particle diameter (B) is within the above-described range, degradation in the fluidity of the toner and occurrences of development streak and fog can be suppressed favorably. Also, the number average particle diameter B of the inorganic fine particles is preferably 5 nm or more and 50 nm or less.

A method for producing the toner base particles according to the present invention is not specifically limited insofar as a toner having an average circularity of 0.960 or more is obtained. Examples of methods for producing a toner having a high circularity include methods, e.g., a suspension polymerization method, an interfacial polymerization method, and a dispersion polymerization method, in which a toner is directly produced in a hydrophilic medium, (hereafter may be referred to as polymerization methods) and a method for producing pulverized toner subjected to thermal spheronization.

Among them, the toner can be produced by the suspension polymerization method because the individual particles are almost spherical uniformly, the distribution of the amount of charge is relatively uniform and, thereby, high transferability is exhibited.

The suspension polymerization method is a polymerization method which produces toner base particles through at least a granulation step to produce droplets of polymerizable monomer composition by dispersing the polymerizable monomer composition containing at least a polymerizable monomer, a colorant, and a wax into an aqueous medium and a polymerization step to polymerize the polymerizable monomer in the droplets. In the case where the toner according to the present invention is produced, a low-molecular weight resin can be contained in the polymerizable monomer composition.

The toner according to the present invention can be a toner including toner base particles having at least a core portion and a shell portion. In the toner base particle, the shell portion is present in such a way as to cover the core portion. Such a structure is employed and, thereby, poor charging and blocking due to oozing of the core portion to the toner particle surface are prevented. Furthermore, a surface layer portion having a resin composition different from that of the shell portion can be present on the surface of the shell portion. The presence of this surface layer portion further improves the environment stability, the durability, and the blocking resistance.

Vinyl based polymerizable monomers can be mentioned as the polymerizable monomers usable for forming the toner base particles according to the present invention. Examples thereof include styrene; styrene derivatives, e.g., α-methyl styrene, β-methyl styrene, o-methyl styrene, m-methyl styrene, p-methyl styrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, and p-phenyl styrene; acrylic polymerizable monomers, e.g., methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate; methacrylic polymerizable monomers, e.g., methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethylphosphateethyl methacrylate, and dibutylphosphateethyl methacrylate; methylene aliphatic monocarboxylic acid esters; vinyl esters, e.g., vinyl acetate, vinyl propionate, vinyl butyrate, vinyl benzoate, and vinyl formate; vinyl ethers, e.g., vinyl methyl ether, vinyl ethyl ether, and vinyl isobutyl ether; and vinyl ketones, e.g., vinyl methyl ketone, vinyl hexyl ketone, and vinyl isopropyl ketone.

The shell portion is composed of vinyl based polymers formed from these vinyl based polymerizable monomers and added vinyl based polymers. Among these vinyl based polymers, styrene polymers, styrene-acrylic copolymers, or styrene-methacrylic copolymers can be employed from the viewpoint of efficient covering of the wax mainly constituting the inside or the central portion.

The wax can be employed as the material constituting the core portion of the toner according to the present invention.

Examples of wax components usable for the toner according to the present invention include petroleum based wax and derivatives thereof, e.g., paraffin wax, microcrystalline wax, and petrolatum, montan wax and derivatives thereof, hydrocarbon wax by a Fischer Tropsch process and derivatives thereof, polyolefin wax and derivatives thereof, e.g., polyethylene and polypropylene, and natural wax and derivatives thereof, e.g., carnauba wax and candelilla wax, where derivatives include oxides, block copolymers with vinyl based monomer, and graft modified products. In addition, higher aliphatic alcohols, aliphatic acids, e.g., stearic acid and palmitic acid, and compounds thereof, acid amid wax, ester wax, ketones, hardened castor oil and derivatives thereof, plant wax, animal wax, and silicone resins are also used.

Those toned into the individual colors by using carbon black serving as a black colorant, magnetic materials, yellow/magenta/cyan colorants are utilized. In particular, most of dyes and carbon black have a polymerization inhibiting property and, therefore, care is needed in the use.

Examples of yellow colorants include compounds typified by condensed azo compounds, isoindolinone compounds, anthraquinone compounds, azo metal complexes, methine compounds, and acrylamide compounds. Specific examples include C.I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Examples of colorants include condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples include C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, 269, and C.I. Pigment Violet 19.

Examples of cyan colorants include copper phthalocyanine compounds and derivatives thereof, anthraquinone compounds, and basic dye lake compounds. Specific examples include C.I. Pigment Blue 1, 7, 15, 15:1, 15:2, 15:3, 15:4, 60, 62, and 66.

These colorants may be used alone, in combination, or in the state of solid solution. The colorant is selected from the viewpoint of the hue angle, the saturation, the brightness, the light resistance, the OHP transparency, and the dispersibility into the toner. The amount of addition of the colorant used is 1 to 20 parts by mass relative to 100 parts by mass of polymerizable monomer or binder resin.

Furthermore, it is possible that the toner according to the present invention is specified to be a magnetic toner by containing a magnetic material as a colorant. In this case, the magnetic material may also play the roll of a colorant. Examples of magnetic materials include iron oxides, e.g., magnetite, hematite, and ferrite; metals, e.g., iron, cobalt, and nickel, alloys of these metals and metals, e.g., aluminum, cobalt, copper, lead, magnesium, tin, zinc, antimony, beryllium, bismuth, cadmium, calcium, manganese, selenium, titanium, tungsten, and vanadium, and mixtures thereof. The above-described magnetic material can be a magnetic material subjected to a surface treatment. In the case where the magnetic toner is prepared by a polymerization method, a hydrophobic treatment can be performed with surface modification agent composed of a substance which does not inhibit polymerization. Examples of such surface modification agents include silane coupling agents and titanium coupling agents. These magnetic materials have number average particle diameters of 2 μm or less, and further preferably 0.1 μm or more and 0.5 μm or less. The content in the toner particles is 20 parts by mass or more and 200 parts by mass or less relative to 100 parts by mass of polymerizable monomer or binder resin, and particularly preferably 40 parts by mass or more and 150 parts by mass or less relative to 100 parts by mass of binder resin.

It is necessary that the average circularity of the toner according to the present invention be 0.960 or more. If the average circularity is less than 0.960, although the cleanability according to the present invention is achieved, the thin line reproducibility is degraded. The average circularity of the toner is preferably 0.970 or more because the thin line reproducibility is good.

The thin line reproducibility is improved more favorably in the case where the content of particles having a circularity of 0.99 or more in the toner is 10% or more.

In the case where the toner base particles are produced by the pulverization method, production may be performed through the following steps.

In a raw material mixing step, a predetermined amount of polyester resin, colorant, and other additive serving as materials for constituting the toner particles are weighed, blended, and mixed. Examples of mixing apparatuses include a double cone mixer, a V-type mixer, a drum type mixer, a super mixer, a Henschel mixer, a NAUTA mixer, and MECHANO HYBRID (produced by NIPPON COKE & ENGINEERING CO., LTD.).

The mixed materials are melt-kneaded to disperse the colorant and the like into the polyester resin. In the melt-kneading step, a batch type kneader, e.g., a pressure kneader or a Banbury mixer, or a continuous kneader may be used. A single screw extruder or a twin screw extruder goes mainstream because of the superiority in the possibility of continuous production. Examples thereof include KTK type twin-screw extruder (produced by Kobe Steel, Ltd.), TEM type twin-screw extruder (produced by TOSHIBA MACHINE CO., LTD.), PCM kneader (produced by Ikegai Corporation), a twin-screw extruder (produced by KCK ENGINEERING CO., LTD.), Ko-Kneader (produced by BUSS), and KNEADEX (produced by NIPPON COKE & ENGINEERING CO., LTD.). The resin composition obtained by performing melt-kneading may be rolled with a two-roll mill or the like and be cooled with water or the like in a cooling step.

The cooled resin composition is pulverized to a predetermined particle diameter in a pulverization step. In the pulverization step, coarse crushing is performed with, for example, a crusher, a hammer mill, or a feather and, thereafter, further pulverization into fine particles is performed with, for example, Kryptron System (produced by Kawasaki Heavy Industries Ltd.), Super Rotor (produced by NISSHIN ENGINEERING INC.), Turbo Mill (produced by FREUND-TURBO CORPORATION), or a pulverizer of air-jet system.

Subsequently, as necessary, classification is performed by using a classifier or a sieving machine, e.g., an elbow jet of inertial classification system (produced by Nittetsu Mining Co., Ltd.), TURBO-FLEX of centrifugal classification system (produced by Hosokawa Micron Corporation), TSP Separator (produced by Hosokawa Micron Corporation), or Faculty (produced by Hosokawa Micron Corporation) to obtain toner particles.

After pulverization, a method for spheronizing toner base powders is performed by using Hybridization System (produced by NARA MACHINERY CO., LTD.), MECHANO-FUSION System (produced by Hosokawa Micron Corporation), Faculty (produced by Hosokawa Micron Corporation), or Meteorainbow MR Type (produced by Nippon Pneumatic Manufacturing Co., Ltd.).

Examples of mixers to add the external additive to the toner particles include Henschel mixer (produced by NIPPON COKE & ENGINEERING CO., LTD.), Super Mixer (produced by KAWATA MFG CO., Ltd.), NOBILTA (produced by Hosokawa Micron Corporation), and Hybridizer (produced by NARA MACHINERY CO., LTD.). Among them, NOBILTA can be employed in order to control the isolation rate of the external additive and apply the external additive uniformly.

Examples of sieving apparatuses used for sieving coarse particles after external addition include Ultrasonic (produced by KOEI SANGYO CO., LTD.); Resonasieve, Gyro-Shifter (TOKUJU CORPORATION); Vibra-Sonic System (produced by Dalton Co., Ltd.); Soniclean (produced by SINTOKOGIO, LTD); Turbo Screener (produced by Turbo Kogyo Co., Ltd.); and MICROSHIFTER (produced by Makino Mfg. Co., Ltd.).

The toner according to the present invention may be used as a one-component developing agent and may also be used as a two-component developing agent in combination with the magnetic carrier.

As for the magnetic carrier, generally known materials, for example, magnetic materials, e.g., an iron powder having an oxidized surface or an iron powder not oxidized; metal particles of iron, lithium, calcium, magnesium, nickel, copper, zinc, cobalt, manganese, and rare earth, alloy particles thereof, and oxide particles thereof; and ferrite, and a magnetic material-dispersed resin carrier (so-called resin carrier) containing a magnetic material and a binder resin to hold this magnetic material in the dispersed state may be used.

In the case where the toner according to the present invention is mixed with a magnetic carrier and is used as the two-component developing agent, the mixing ratio of the magnetic carrier is preferably 2 percent by mass or more and 15 percent by mass or less on a toner concentration in the developing agent basis.

Figure 2:
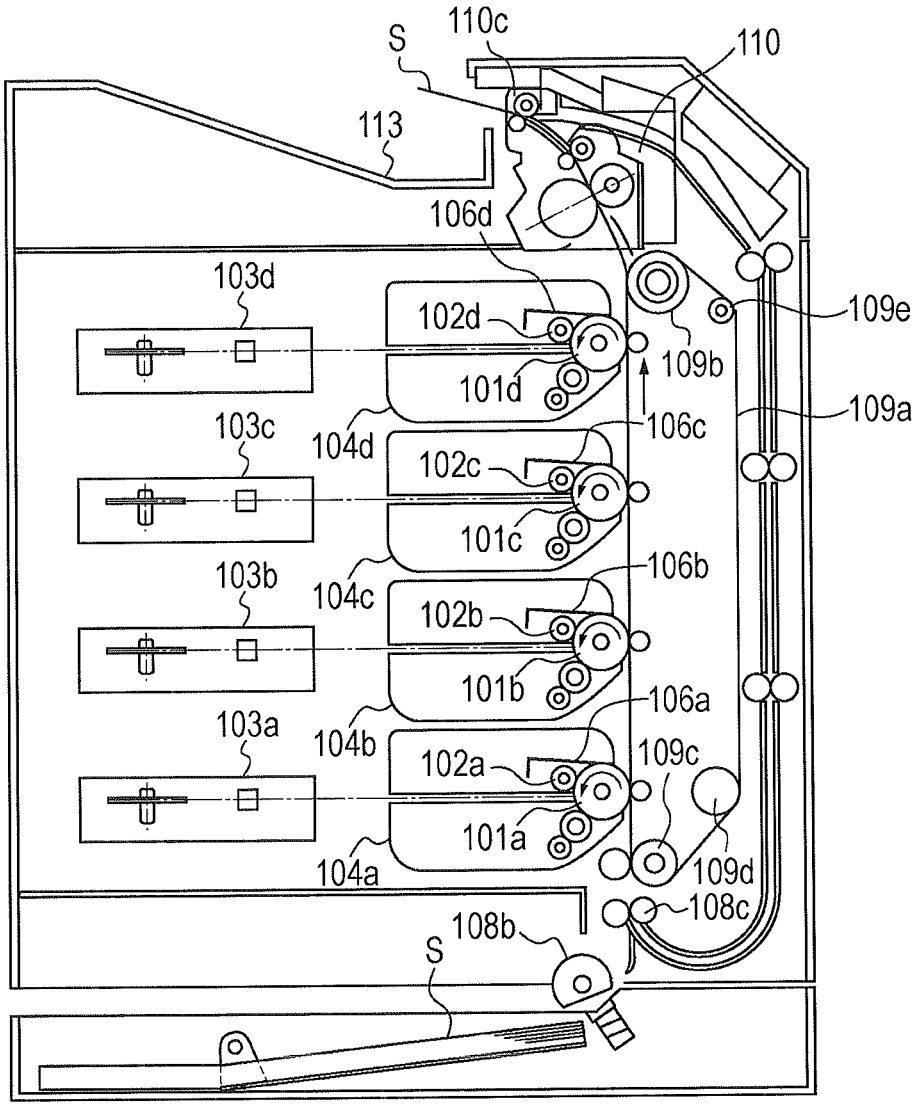
FIG. 2 shows a schematic configuration diagram of one embodiment of an image forming apparatus in which the toner according to the present invention is used.

Next, an example of image forming method (contact one-component development system) will be described with reference to FIG. 2 and FIG. 3. In FIG. 2, reference numeral 101 (101*a* to 101*d*) denotes a photosensitive drum (image bearing member, electrophotographic photo conductor) which rotates in a direction indicated by an arrow shown in the drawing at a predetermined process speed. The photosensitive drums 101*a*, 101*b*, 101*c*, and 101*d* are for a yellow (Y) component, a magenta (M) component, a cyan (C) component, and a black (Bk) component, respectively, of a color image. These photosensitive drums 101*a* to 101*d* are driven to rotate by a drum motor (direct current servomotor), although not shown in the drawing. The individual photosensitive drums 101*a* to 101*d* may be provided with their respective drive sources independently. The drive to rotate the drum motor is controlled by a digital signal processor (DSP), although not shown in the drawing, and other control is performed by CPU, although not shown in the drawing. An electrostatic attraction-transportation belt 109*a* is stretched around a driving roller 109*b*, fixed rollers 109*c* and 109*e*, and tension roller 109*d* and is driven to rotate by the driving roller 109*b* in a direction indicated by an arrow shown in the drawing to attract and transport a transfer material S (recording medium S).

Among the four colors, yellow (Y) will be described below as an example. The photosensitive drum 101*a* is uniformly subjected to a first charging treatment to have a predetermined polarity and potential by a first charging device 102*a* during the rotation (charging step). The photosensitive drum 101*a* is subjected to light image exposure with a laser beam exposure device (hereafter referred to as scanner) 103*a*, and a latent image in accordance with the image information is formed on the photosensitive drum 101*a* (latent image formation step). A toner image is formed on the photosensitive drum 101*a* (on the image bearing member) by a development portion 104*a* and, thereby, an electrostatic latent image is visualized (development step). The same steps are executed with respect to each of the other three colors (magenta (M), cyan (C), and black (Bk)).

The toner images of the four colors are synchronized by a resist roller 108*c*, which stops and re-transports the recording medium S transported from the paper feed roller 108*b* at predetermined timings, and the toner images are transferred sequentially to the recording medium S in a nip portion between the photosensitive drums 101*a* to 101*d* and the electrostatic attraction-transportation belt 109*a* (transfer step). At the same time with this, the photosensitive drums 101*a* to 101*d* after transfer of the toner images to the recording medium S are subjected to removal of residual adhered materials, e.g., toners remaining after transfer, with cleaning devices 106*a*, 106*b*, 106*c*, and 106*d* and are used for forming images repeatedly. The recording medium S, to which the toner images have been transferred from the four photosensitive drums 101*a* to 101*d*, is separated from the surface of the electrostatic attraction-transportation belt 109*a* in a driving roller 109*b* portion and is sent into a fixing device 110. After the toner images are fixed in the fixing device 110 (fixing step), the recording medium S is discharged to a discharge tray 113 with a discharge roller 110*c*.

Figure 3:
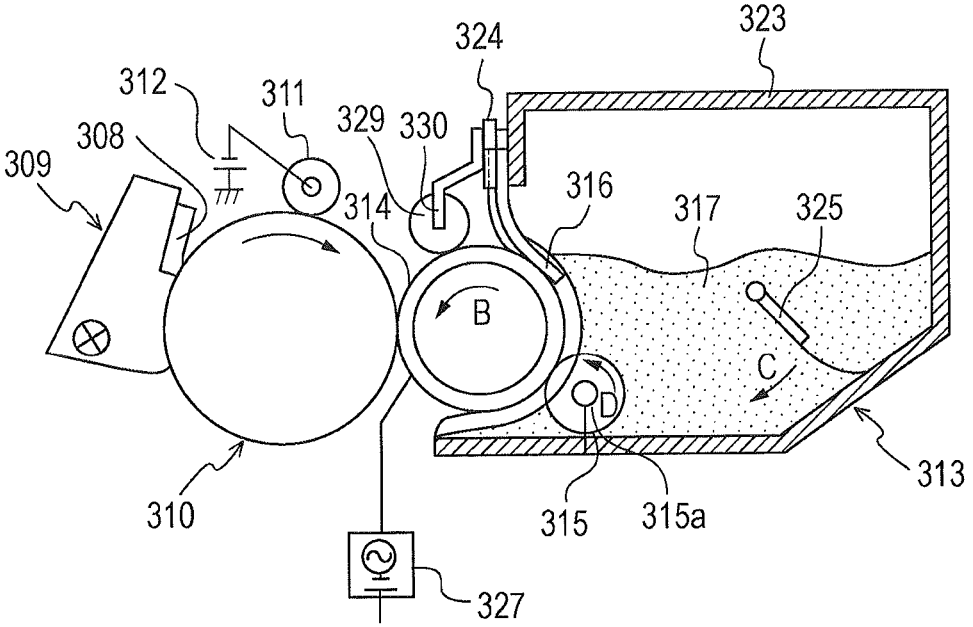
FIG. 3 shows a magnified configuration diagram of development and cleaning portions used for the image forming apparatus shown in FIG. 2.

A specific example of the image forming method by a non-magnetic one-component contact development system will be described with reference to a magnified diagram of the development portion (FIG. 3). In FIG. 3, a development unit 313 includes a developing agent container 323 holding a non-magnetic toner 317 serving as a one-component developing agent and a toner bearing member 314 which is located at an opening portion extending in the longitudinal direction in the developing agent container 323 and which is disposed opposing to the photosensitive drum 310. The toner 317 is transported to the photosensitive drum side (in the direction indicated by an arrow C) with a toner transportation member 325. The development unit 313 is configured to develop the electrostatic latent image on the photosensitive drum 310 to form a toner image. A latent image bearing member contact charging member 311 is in contact with the photosensitive drum 310. The bias of the latent image bearing member contact charging member 311 is applied by a power supply 312. The toner bearing member 314 is horizontally disposed in the above-described opening portion in such a way that nearly a right half of the peripheral surface shown in the drawing is protruded into the developing agent container 323 and nearly a left half of the peripheral surface is exposed to the outside of the developing agent container 323. As shown in FIG. 3, the surface exposed to the outside of the developing agent container 323 is in contact with the photosensitive drum 310 located at the left to the development unit 313 in the drawing. The toner bearing member 314 is driven to rotate in the direction indicated by an arrow B, the photosensitive drum 310 is rotated at a peripheral speed of 50 to 170 mm/s, and the toner bearing member 314 is rotated at a peripheral speed 1 to 2 times the peripheral speed of the photosensitive drum 310.

A regulation member 316, in which a metal plate of SUS or the like, a rubber material, e.g., urethane or silicone, or a metal thin plate of SUS or phosphor bronze serves as a base member and a rubber material is bonded on the side of the surface in contact with the toner bearing member 314, is supported by a regulation member support sheet metal 324 at the position above the toner bearing member 314. The regulation member 316 is disposed in such a way that the vicinity of the end on the free end side comes into face contact with the outer peripheral surface of the toner bearing member 314, and the contact direction is a counter direction, where the end side is located on the upstream side of the rotation direction of the toner bearing member 314. An example of the regulation member 316 has a configuration in which a tabular urethane rubber having a thickness of 1.0 mm is bonded to the regulation member support sheet metal 324, and the contact pressure (linear pressure) on the toner bearing member 314 is set appropriately. The contact pressure is preferably 20 to 300 N/m. In the measurement of the contact pressure, three metal thin plates having a known friction coefficient are inserted into the contact portion, the center sheet is drawn with a spring balance, and the resulting value is converted. The regulation member 316 in which the rubber material is bonded on the side of the contact surface can be employed from the viewpoint of the adhesion to the toner because fusion and fixation of the toner to the regulation member is suppressed in the long term of use. It is also possible that the state of contact of the regulation member 316 with the toner bearing member 314 is specified to be edge contact, where the end is allowed to come into contact. In the case where the edge contact is employed, the contact angle of the regulation member 316 with respect to a tangent line to the toner bearing member 314 at the contact point with the toner bearing member 314 can be set at 40 degrees or less from the viewpoint of layer regulation of the toner. A toner feed roller 315 (reference numeral 315*a* denotes an axis of the toner feed roller) is brought into contact with the toner bearing member 314 on the upstream side of the contact portion between the regulation member 316 and the surface of the toner bearing member 314 in the rotation direction of the toner bearing member 314 and is supported rotatably (in FIG. 3, in the direction indicated by an arrow D). It is effective that the contact width of the toner feed roller 315 and the toner bearing member 314 is 1 to 8 mm, and the toner feed roller 315 can have a relative velocity with respect to the toner bearing member 314 at the contact portion.

A charge roller 329 is not indispensable but can be disposed. The charge roller 329 is an elastic body, e.g., NBR or silicone rubber, and is attached to a pressing member 330. The contact load of the charge roller 329 to the toner bearing member 314 due to the pressing member 330 is set at 0.49 to 4.9 N. The toner layer on the toner bearing member 314 is closely filled and uniformly applied because of the contact with the charge roller 329. As for the longitudinal positional relationship between the regulation member 316 and the charge roller 329, the charge roller 329 can be disposed in such a way as to reliably cover the whole contact region of the regulation member 316 on the toner bearing member 314. It is necessary that the charge roller 329 be driven following the toner bearing member 314 or at the same peripheral speed. If there is a difference in peripheral speed between the charge roller 329 and the toner bearing member 314, the toner coating becomes nonuniform and, unfavorably, variations occur on the image. The bias of the charge roller 329 is applied between the two, the toner bearing member 314 and the photosensitive drum 310, by the power supply 327 as a direct current, and a charge is given to the non-magnetic toner 317 on the toner bearing member 314 by discharge from the charge roller 329. The bias of the charge roller 329 is a bias which has the same polarity with the polarity of the non-magnetic toner and which is more than the discharge start voltage and is set in such a way that a potential difference of 1,000 to 2,000 V occurs relative to the toner bearing member 314. After a charge is given from the charge roller 329, the thin film toner layer formed on the toner bearing member 314 is transported uniformly to a development portion which is a portion opposite to the photosensitive drum 310. In this development portion, the thin film toner layer formed on the toner bearing member 314 is developed as a toner image of the electrostatic latent image on the photosensitive drum 310 by a direct current bias applied between the two, the toner bearing member 314 and the photosensitive drum 310, from the power supply 327 shown in FIG. 3. After the toner image is transferred to the transfer member, toners remaining after transfer is cleaned with a cleaning blade 308 provided on the cleaning unit 309.

In the present example, the cleaning blade 308 is held at an end portion of a support formed from a sheet metal. The cleaning blade 308 is disposed in such a way that the longitudinal direction thereof becomes nearly parallel to the longitudinal direction of the photosensitive drum 310, one end portion in the short side direction is fixed to the end portion of the support, and the free end which is the other end portion in the short side direction comes into contact with the photosensitive drum 310 in the counter direction.

Rubber materials are suitable for the material of the cleaning blade from the viewpoints of the capability to track the surface of the photo conductor and difficulty in damaging the surface of the photo conductor. Among them, polyurethane rubber is most suitable from the viewpoints of properties and chemical durability. The rubber hardness of the rubber material constituting the cleaning blade is preferably 60 degrees or more and 90 degrees or less on an international rubber hardness degree (IRHD) basis from the viewpoint of the stability of cleaning of the toner from the photo conductor.

The cleanability is significantly influenced by setting of the contact angle and the contact linear pressure of the cleaning blade. As for the method for bring the cleaning blade into contact, the rubber blade can be fixed to the support inclined 15° or more and 45° or less with respect to the tangent line of the photo conductor at the contact position of the cleaning blade and be brought into contact counter.

The contact linear pressure of the cleaning blade is set at preferably about 10 N/m or more and 100 N/m or less from the viewpoint of prevention of slipping through of the toner. The contact linear pressure may be measured by disposing a load converter (load cell) in a portion where the cleaning blade is fixed. As for the measuring method, the cleaning apparatus in the image forming apparatus main body may be modified and the load converter may be disposed. However, the measurement is performed easily by utilizing HEIDON Friction Tester (Tribo Station TYPE 32 Modified Machine) produced by Shinto Scientific Co., Ltd.

In this regard, the contact angle and the contact linear pressure of the cleaning blade and the photosensitive drum in the present invention are values when the photosensitive drum is at a standstill.

The photosensitive drum includes a support, a charge generation layer disposed on the support, and a charge transport layer disposed on the charge generation layer and is a photosensitive drum in which the charge transport layer serves as a surface layer.

The charge transport layer can have a matrix-domain structure composed of a matrix and a domain.

An improvement in the cleanability is influenced by the slippiness between the cleaning blade in contact with the photosensitive drum and the photosensitive drum. If the slippiness between the cleaning blade and the photosensitive drum is poor, the cleaning blade is deformed during rotation of the photosensitive drum, the photosensitive drum is worn easily, the surface state of the photosensitive drum is changed during the use, and the toner slips through easily. In the case where the matrix-domain structure composed of a matrix and a domain is present on the photosensitive drum surface, the slippiness of the photosensitive drum is enhanced, and the cleanability can be improved.

At that time, the domain contains a polyester resin A having a repeated structure unit represented by the following formula (A) and a repeated structure unit represented by the following formula (B). Also, the matrix contains at least one resin selected from the group consisting of a polyester resin C having a repeated structure unit represented by the following formula (C) and a polycarbonate resin D having a repeated structure unit represented by the following formula (D) and a charge transport substance. The content of the repeated structure unit represented by the following formula (A) is preferably 10 percent by mass or more and 40 percent by mass or less relative to the total mass of the polyester resin A. The content of the repeated structure unit represented by the following formula (B) is preferably 60 percent by mass or more and 90 percent by mass or less relative to the total mass of the polyester resin A.

[Chem. 1]

(A)

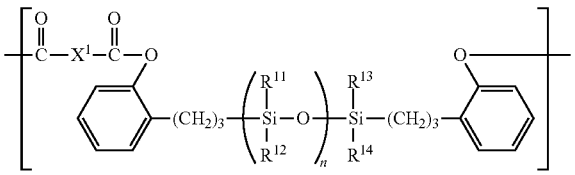

In the formula (A), $X^1$ represents a m-phenylene group, a p-phenylene group, or a divalent group in which two p-phenylene groups are bonded with an oxygen atom therebetween, $R^{11}$ to $R^{14}$ represent independently a methyl group, an ethyl group, or a phenyl group, n represents the number of repetition of the unit in the parentheses, and an average value of n in the polyester resin A is 20 or more and 120 or less.

[Chem. 2]

(B)

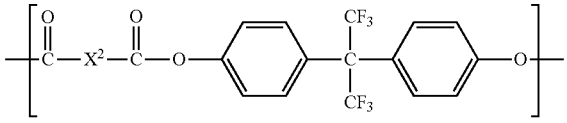

In the formula (B), $X^2$ represents a m-phenylene group, a p-phenylene group, or a divalent group in which two p-phenylene groups are bonded with an oxygen atom therebetween.

[Chem. 3]

(C)

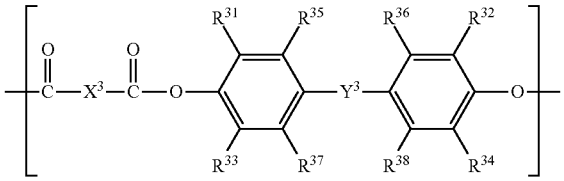

In the formula (C), $R^{31}$ to $R^{38}$ represent independently a hydrogen atom or a methyl group, $X^3$ represents a m-phenylene group, a p-phenylene group, or a divalent group in which two p-phenylene groups are bonded with an oxygen atom therebetween, and $Y^3$ represents a single bond, a methylene group, an ethylidene group, or a propylidene group.

[Chem. 4]

(D)

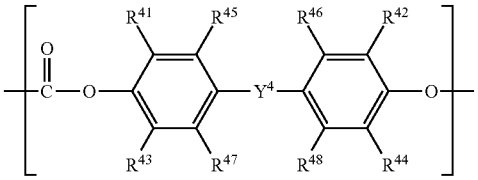

In the formula (D), $R^{41}$ to $R^{48}$ represent independently a hydrogen atom or a methyl group, and $Y^4$ represents a methylene group, an ethylidene group, a propylidene group, a phenylethylidene group, a cyclohexylidene group, or an oxygen atom.

Polyester Resin A

The polyester resin A has the repeated structure unit represented by the above-described formula (A) and the repeated structure unit represented by the above-described formula (B).

In the formula (A), $X^1$ represents a m-phenylene group, a p-phenylene group, or a divalent group in which two p-phenylene groups are bonded with an oxygen atom therebetween. These groups may be used alone, or at least two types may be used in combination. In the case where the m-phenylene group and the p-phenylene group are used in combination, the ratio (molar ratio) of the m-phenylene group to the p-phenylene group is preferably 1:9 to 9:1, and more preferably 3:7 to 7:3.

In the formula (A), $R^{11}$ to $R^{14}$ can be a methyl group from the viewpoint of lasting relaxation of the above-described contact stress.

In the formula (A), the average value of n in the polyester resin A is 20 or more and 120 or less. In the case where n is 20 or more and 120 or less, the domain containing the polyester resin A is efficiently formed in the matrix containing the charge transport substance, the polyester resin C, and the polycarbonate resin D. In particular, the average value of n is preferably 40 or more and 80 or less. Furthermore, n which represents the number of repetition of the unit in the parentheses can be within the range of ±10% the value indicated by the average value of n representing the number of repetition because the effects of the present invention are exhibited stably.

A specific example of the repeated structure unit represented by the formula (A) is as described below.

[Chem. 5]
(A-1)
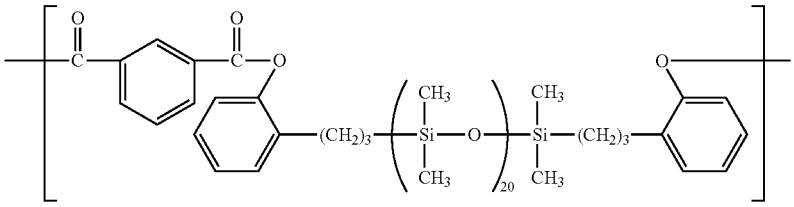
(A-2)
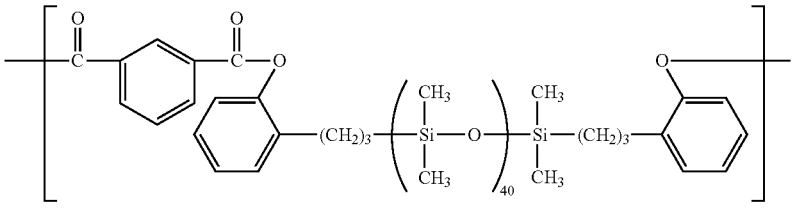
(A-3)
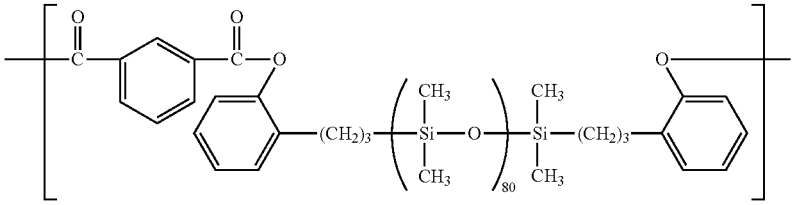
(A-4)
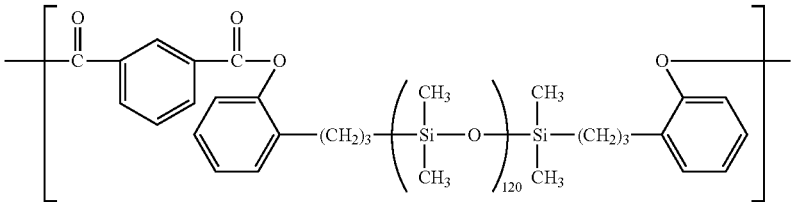
(A-5)
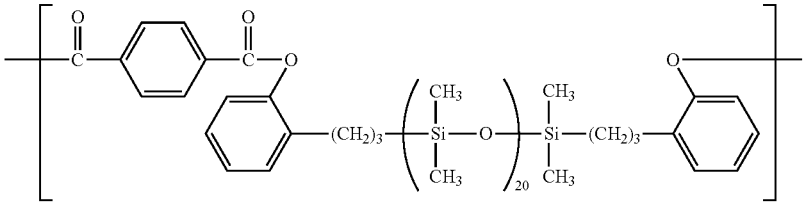
(A-6)
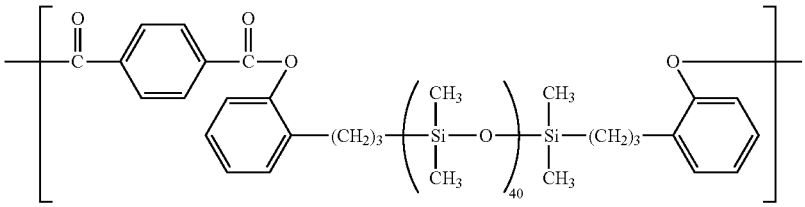
(A-7)
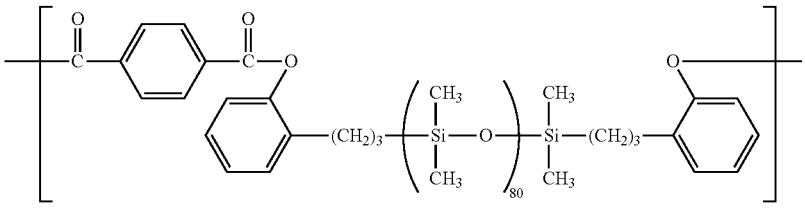

A specific example of the repeated structure unit represented by the formula (B) is as described below.

[Chem. 6]

(B-1)

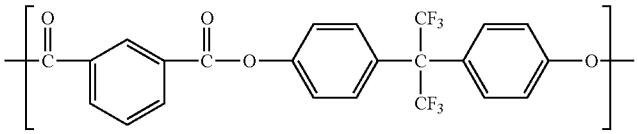

(B-2)

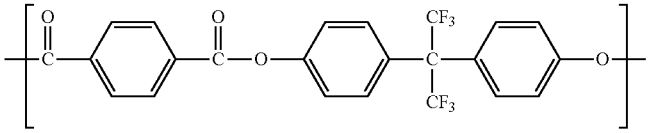

(B-3)

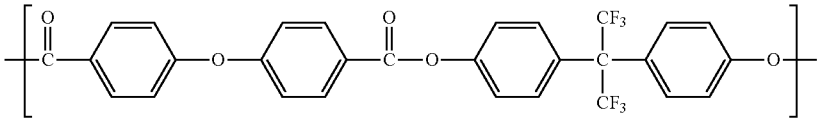

Polyester Resin C

The polyester resin C having the repeated structure unit represented by the formula (C) will be described. In the formula (C), $Y^3$ can be a propylidene group. A specific example of the repeated structure unit represented by the formula (C) is as described below.

[Chem. 7]

(C-1)

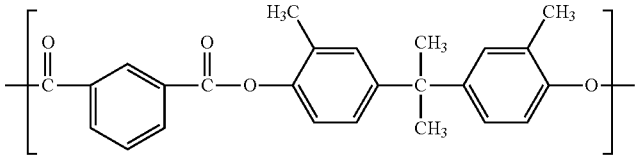

(C-2)

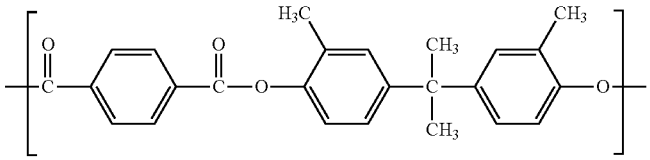

(C-3)

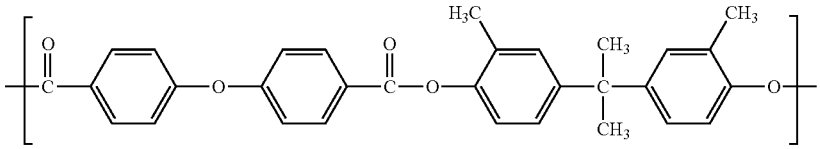

(C-4)

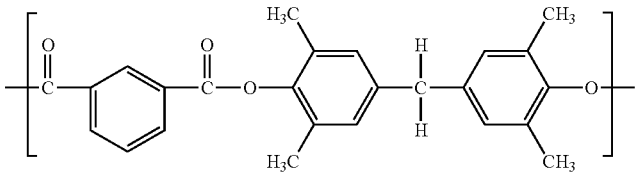

(C-5)

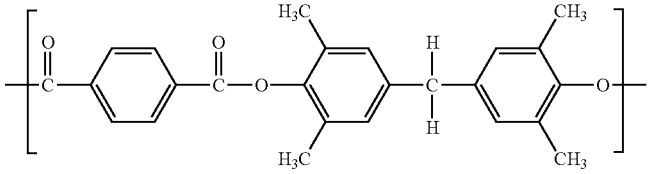

-continued (C-6)

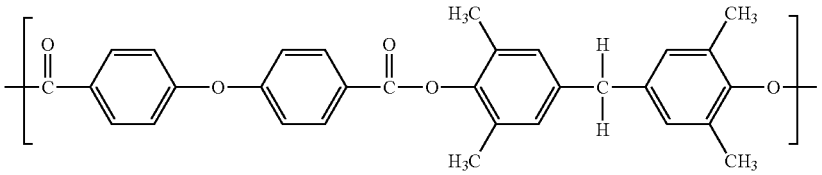

Polycarbonate Resin D

The polycarbonate resin D having the repeated structure unit represented by the formula (D) will be described. In the formula (D), $Y^4$ can be a propylidene group or a cyclohexylidene group.

Specific examples of the repeated structure unit represented by the formula (D) are as described below. Among them, the repeated structure unit can be represented by the formula (D-1), (D-2), (D-3), or (D-4).

[Chem. 8]

(D-1)

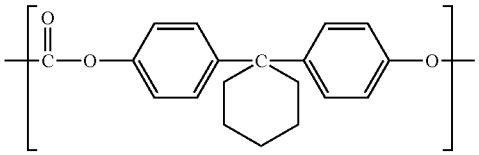

(D-2)

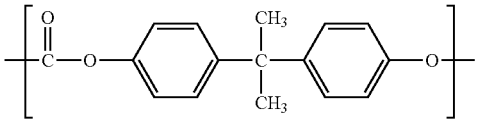

(D-3)

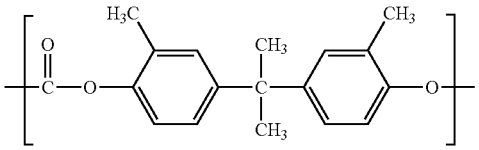

(D-4)

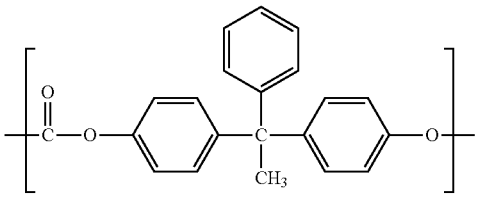

(D-5)

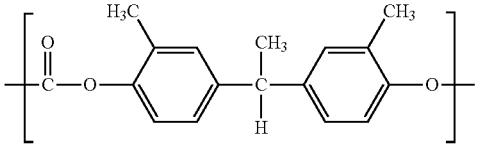

(D-6)

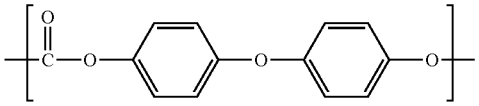

-continued (D-7)

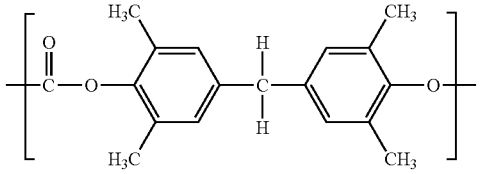

(D-8)

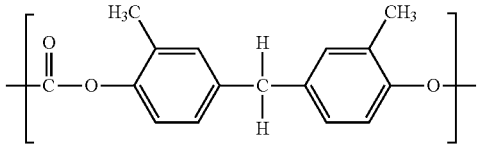

Charge Transport Substance

The charge transport layer contains a charge transport substance. Examples of charge transport substances include triarylamine compounds, hydrazone compounds, butadiene compounds, and enamine compounds. At least one type of these charge transport substances may be used. Among them, triarylamine compounds can be used as the charge transport substance from the viewpoint of improvements in electrophotographic characteristics. Compounds not containing fluorine atom can be used as the charge transport substance. Specific examples of charge transport substances are as described below.

[Chem. 9]

(E-1)

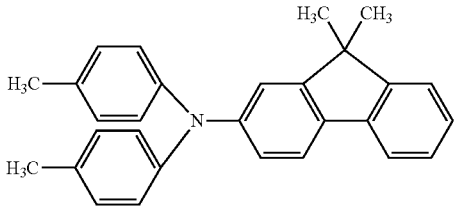

(E-2)

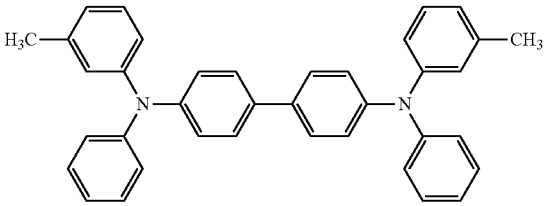

The charge transport layer according to the present invention has the matrix-domain structure including the matrix containing at least one resin of the polyester resin C and the polycarbonate resin D and the domain containing the polyester resin A in the matrix. The charge transport substance can be contained in the matrix.

In the matrix-domain structure, the matrix corresponds to the sea in the "sea-island structure" and the domain corresponds to the island. The domain containing the polyester resin A shows a particulate (island-shaped) structure formed in the matrix containing at least one resin of the polyester resin C and the polycarbonate resin D. The domain contains the polyester resin A and the domains are present independently from each other in the above-described matrix. Such a matrix-domain structure may be ascertained by performing surface observation of the charge transport layer or cross-sectional observation of the charge transport layer.

Observation of the state of the matrix-domain structure or the measurement of the domain may be performed by using, for example, commercially available laser microscope, optical microscope, electron microscope, or atomic force microscope. Observation of the state of the matrix-domain structure or the measurement of the domain structure may be performed by using the above-described microscope under a predetermined magnification.

The number average particle diameter of the domains containing the polyester resin A is preferably 100 nm or more and 1,000 nm or less. The particle size distribution of the particle diameters of the individual domains can be narrower from the viewpoints of uniformity of the coating film and a stress relaxation effect. As for the number average particle diameter, 100 domains are randomly selected from domains observed by microscope observation of the cross-section of the charge transport layer cut vertically, the maximum diameter of each domain selected is measured, and the number average particle diameter of the domains is calculated by averaging the maximum diameters of the individual domains. In this regard, the image information in the depth direction is obtained by observing the cross-section of the charge transport layer with the microscope and, therefore, a three-dimensional image of the charge transport layer may be obtained.

Method for Measuring Abundance Ratio of Inorganic Fine Particles on Organic-Inorganic Composite Fine Particle Surfaces In the case where the inorganic fine particles are silica particles, the abundance ratio of the inorganic fine particles on the organic-inorganic composite fine particle surfaces is calculated from the atomic weight of silicon (hereafter referred to as Si) derived from silica and measured by ESCA (X-ray photoelectron spectroscopy). Atoms of the organic-inorganic composite fine particle surface may be detected because ESCA is an analytical method for detecting atoms in the region of several nanometers or less in the depth direction of the sample surface.

As for a sample holder, a platen 75 mm square (provided with a tapped hole having a diameter of about 1 mm for fixing sample) attached to an apparatus is used. The tapped hole of the platen is penetrated and, therefore, the hole is plugged with a resin or the like, and a concave portion having a depth of about 0.5 mm for a powder measurement is formed. A measurement sample is filled into the concave portion with a spatula or the like and is leveled off, so that a sample is formed.

The apparatus and the measurement condition of ESCA are as described below.

Apparatus for use: Quantum 2000 produced by ULVAC-PHI, Inc.

Analytical method: narrow analysis

Measurement condition:

X-ray source: Al-Kα

X-ray condition: 100μ 25 W 15 kV

Photoelectron take-off angle: 45°

PassEnergy: 58.70 eV

Measurement range: ϕ 100 μm

Measurement is performed under the above-described condition.

In the analysis method, initially, the peak derived from a C—C bond of the carbon is orbit is corrected to 285 eV. Subsequently, the amount of Si derived from silica relative to the total amount of constituent elements is calculated from the peak area derived from the silicon 2p orbit, where a peak top is detected at 100 eV or more and 105 eV or less, by using the relative sensibility factor offered by ULVAC-PHI, Inc.

The organic-inorganic composite fine particles are measured. Also, particles of inorganic components used in formation of the organic-inorganic composite fine particles are measured in the same manner. In the case where the inorganic component is silica, the ratio of "amount of Si in measurement of organic-inorganic composite fine particles" to "amount of Si in measurement of silica particles" is taken as the abundance ratio of the inorganic fine particles on the organic inorganic-composite fine particle surfaces according to the present invention. In the present measurement, calculation is performed by using sol-gel silica particles (number average particle diameter 110 nm) as silica particles.

The method for separating the organic-inorganic composite fine particles from the toner may be, for example, a method described in the method for quantifying organic-inorganic composite fine particles and inorganic fine particles in the toner.

The case where the inorganic fine particles are silica particles has been explained. In the case where the inorganic fine particles are not silica particles, metal species contained in the inorganic fine particles may be identified from the data base attached to the measurement apparatus, and the analysis may be performed noting the metal species.

Method for Measuring Number Average Particle Diameter of External Additive

The number average particle diameter of the external additive is measured by using a scanning electron microscope "S-4800" (trade name; produced by Hitachi, Ltd.). The toner including the external additive is observed and major diameters of randomly selected 100 primary particles of external additive are measured in a field of view under magnification of 100,000 times to 200,000 times and the number average particle diameter is determined. The magnification of the observation is adjusted in accordance with the size of the external additive.

Method for Measuring SF-1 and SF-2 of External Additive

The external additive on the toner is observed with a scanning electron microscope "S-4800" (produced by Hitachi, Ltd.). The maximum lengths and the circumference lengths of 100 primary particles were calculated in a field of view under magnification of 100,000 times to 200,000 times, and SF-1 and SF-2 of the external additive are calculated by using image processing software Image-PRO Plus5.1J (produced by MediaCybernetics).

Also, as for the area of the particle, the external additive is observed with a scanning electron microscope "S-4800" (produced by Hitachi, Ltd.) in a magnified field of view. The area of the whole particle containing the organic component and the inorganic component is calculated by using image processing software Image-PRO Plus5.1J (produced by MediaCybernetics).

The values of SF-1 and SF-2 are calculated on the basis of the formulae described below, and the average values thereof are taken as SF-1 and SF-2.

$$SF\text{-}1=(\text{maximum length of primary particle})^2/\text{area of primary particle}\times\pi/4\times100$$

$$SF\text{-}2=(\text{circumference length of primary particle})^2/\text{area of primary particle}\times100/4\pi$$

Method for Measuring True Density of Toner

The true density of the toner is measured with a dry type automatic densimeter Autopychnometer (produced by Yuasa Ionics Co., Ltd.). The condition is as described below.

Cell SM cell (10 mL)

Amount of sample 2.0 g

This measuring apparatus is to measure the true densities of solids and liquids on the basis of a vapor phase substitution method. Although the Archimedes' principle is employed as with a liquid phase substitution method, the accuracy is high because a gas (argon gas) is used as a substitution medium.

Method for Measuring Average Circularity of Toner

The average circularity of the toner is measured with a flow particle image analyzer "FPIA-3000" (produced by SYSMEX CORPORATION) under the measurement and analysis condition of the calibration operation.

The specific measuring method is as described below. About 20 mL of ion-exchanged water, from which impurity solids and the like have been removed in advance, is put into a glass container. About 0.2 mL of diluted liquid prepared by diluting "Contaminon N" (10-percent by mass aqueous solution of neutral detergent for precision measurement appliance cleaning which includes a nonionic surfactant, an anionic surfactant, and an organic builder and which has a pH of 7, produced by Wako Pure Chemical Industries, Ltd.) serving as a dispersing agent with ion-exchanged water by a factor of about 3 on a mass basis is added thereto. Furthermore, about 0.02 g of measurement sample is added, and a dispersion treatment is performed for 2 minutes by using an ultrasonic dispersion device to prepare a dispersion for the measurement. At that time, cooling is performed appropriately in such a way that the temperature of the dispersion becomes 10° C. or higher and 40° C. or lower. As for the ultrasonic dispersion device, a table top ultrasonic cleaner dispersion device (for example, "VS-150" (produced by VELVO-CLEAR)) having an oscillation frequency of 50 kHz and an electrical output of 150 W is used, a predetermined amount of ion-exchanged water is put into a water tank, and about 2 mL of Contaminon N described above is added to this water tank.

In the measurement, the above-described flow particle image analyzer incorporated with "UPlanApro" (magnification 10 times, numerical aperture 0.40) as an objective lens is used and a particle sheath "PSE-900A" (produced by SYSMEX CORPORATION) is used as a sheath liquid. The dispersion prepared in the above-described procedure is introduced into the above-described flow particle image analyzer, and 3,000 toner particles are measured in a total counter mode of the HPF measurement mode. The average circularity of the toner particles is determined, where the binarization threshold value in particle analysis is specified to be 85% and the analysis particle diameter is limited to 1.985 μm or more and 39.69 μm or less on an equivalent circle diameter basis.

In the measurement, automatic focusing is performed before start of the measurement by using standard latex particles (for example, "RESEARCH AND TEST PARTICLES Latex Microsphere Suspensions 5200A" produced by Duke Scientific Corporation is diluted with ion-exchanged water). Thereafter, focusing can be performed every 2 hours from start of the measurement.

In the present example, the flow particle image analyzer subjected to calibration operation by SYSMEX CORPORATION was used, where a calibration certificate was issued. The measurement was performed under the measurement and analysis condition on the basis of the calibration certificate except that the analysis particle diameter was limited to 1.985 μm or more and 39.69 μm or less on an equivalent circle diameter basis.

Method for Measuring Weight Average Particle Diameter (D4) and Number Average Particle Diameter (D1)

The weight average particle diameter (D4) and the number average particle diameter (D1) of the toner are calculated by performing measurements through the use of an accurate particle size distribution analyzer "Multisizer 3 COULTER COUNTER" (registered trademark, produced by Beckman Coulter, Inc.), which is provided with a 100 μm aperture tube and which is on the basis of an electrical sensing zone method, and attached dedicated software "Beckman Coulter Multisizer 3 Version 3.51" (produced by Beckman Coulter, Inc.) which sets the measurement condition and analyzes the measurement data, at the number of effective channels of 25,000, and analyzing the measurement data.

As for an electrolytic aqueous solution used for the measurement, an electrolytic solution in which analytical grade sodium chloride is dissolved into ion-exchanged water in such a way as to have a concentration of about 1 percent by mass, for example, "ISOTON II" (produced by Beckman Coulter, Inc.) may be used.

In this regard, before the measurement and the analysis are performed, the dedicated software is set as described below.

In a "screen for changing a standard operation method of measurement (SOMME)" of the dedicated software, the total count number in the control mode is set at 50,000 particles, the number of measurements is set at 1, and a Kd value is set at a value obtained by using "Standard particles 10.0 μm" (produced by Beckman Coulter, Inc.). A threshold value and a noise level are automatically set by pressing a threshold value/noise level button. In addition, Current is set at 1,600 μA, Gain is set at 2, Electrolytic solution is set at ISOTON II, and Flush of aperture tube after measurement is checked.

In a "screen for setting conversion from pulse to particle diameter" of the dedicated software, Bin interval is set at logarithmic particle diameter, Particle diameter bin is set at 256 particle diameter bin, and Particle diameter range is set at 2 μm to 60 μm.

Specific measuring method is as described below.

(1) About 200 mL of the above-described electrolytic aqueous solution is put into a 250 mL round-bottom glass beaker dedicated to Multisizer 3, the beaker is set into a sample stand, and counterclockwise agitation with a stirrer rod is performed at 24 revolutions/sec. Contamination and air bubbles in the aperture tube are removed by an "aperture flush" function of the analysis software.

(2) About 30 mL of the above-described electrolytic aqueous solution is put into a 100 mL flat-bottom glass beaker. About 0.3 mL of diluted liquid prepared by diluting "Contaminon N" (10-percent by mass aqueous solution of neutral detergent for precision measurement appliance cleaning which includes a nonionic surfactant, an anionic surfactant, and an organic builder and which has a pH of 7, produced by Wako Pure Chemical Industries, Ltd.) serving as a dispersing agent with ion-exchanged water by a factor of 3 on a mass basis is added thereto.

(3) In an ultrasonic dispersion device "Ultrasonic Dispersion System Tetra 150" (produced by Nikkaki Bios Co., Ltd.) including two oscillators, which have an oscillation frequency of 50 kHz, with their phases shifted by 180° from each other and having an electrical output of 120 W, 3.3 L of ion-exchanged water is put into a water tank, and about 2 mL of Contaminon N described above is added to this water tank.

(4) The beaker according to the above-described item (2) is set into a beaker fixing hole of the above-described ultrasonic dispersion device, and the ultrasonic dispersion device is operated. The height position of the beaker is adjusted in such a way that the resonance state of the liquid surface of the electrolytic aqueous solution becomes at a maximum level.

(5) About 10 mg of toner is added gradually to the above-described electrolytic aqueous solution and is dispersed while the electrolytic aqueous solution in the beaker according to the above-described item (4) is irradiated with ultrasonic waves. The ultrasonic dispersion treatment is further continued for 60 seconds. In the ultrasonic dispersion, the water temperature of the water tank is adjusted to become 10° C. or higher and 40° C. or lower.

(6) The electrolytic aqueous solution containing dispersed toner, according to the above-described item (5), is dropped to the round-bottom beaker set into the sample stand, according to the above-described item (1), by using a pipette in such a way that the measured concentration is adjusted to be about 5%. The measurement is performed until the number of measured particles reaches 50,000.

(7) The weight average particle diameter (D4) and the number average particle diameter (D1) are calculated by analyzing the measurement data with the above-described dedicated software attached to the apparatus. In this regard, an "average diameter" on an analysis/volume statistical value (arithmetic mean) screen, where graph/volume % is set in the dedicated software, corresponds to the weight average particle diameter (D4), and an "average diameter" on an analysis/number statistical value (arithmetic mean) screen, where graph/number % is set in the dedicated software, corresponds to the number average particle diameter (D1).

Method for Quantifying Organic-Inorganic Composite Fine Particles and Inorganic Fine Particles in Toner In the case where the content of organic-inorganic composite fine particles is measured in the toner in which a plurality of external additives are added to toner particles, it is necessary that the external additives be removed from the toner particles and the plurality of external additives be isolated and recovered.

Specific examples of the methods include the following methods.

(1) After 5 g of toner is put into a sample bottle, 200 mL of methanol is added.

(2) The external additives are separated by dispersing the sample for 5 minutes with an ultrasonic cleaner.

(3) The toner particles and the external additives are separated by suction filtration (10 μm membrane filter).

(4) The above-described items (2) and (3) are performed three times in total.

The external additives are isolated from the toner particles by the above-described operations. The recovered aqueous solution is treated with a centrifuge to separate and recover the organic-inorganic composite fine particles and the inorganic fine particles. Subsequently, the solvent is removed, drying is performed with a vacuum drier sufficiently, and the weight is measured, so that the contents of the organic-inorganic composite fine particles and the inorganic fine particles are obtained. In the case where a plurality of types of inorganic fine particles are added, separation may be performed by adjusting the centrifugal separation condition.

EXAMPLES

Up to this point, the basic configuration and features of the present invention have been described. The present invention will be specifically described below with reference to examples. However, aspects of the present invention are not limited to them. In the examples, the term "part" refers to a part by mass.

Production Examples of Organic-Inorganic Composite Fine Particles

The organic-inorganic composite fine particles may be produced in accordance with the description of the example in PTL 3.

The organic-inorganic composite fine particles used in the examples described later were produced in accordance with Example 1 in PTL 3 by using silica shown in Table 2. The properties of Organic-inorganic composite fine particles 1 to 11 are shown in Table 2.

Sol-Gel Silica Particles

Sol-gel silica particles which had been surface-treated with hexamethyldisilazane (HMDS) and which had a number average particle diameter of 110 nm were prepared.

Production Examples of Resin Particles

Resin particles 1 were obtained in the same manner as the manner of Organic-inorganic composite fine particles 1 except that 6 parts by mass of nonionic surfactant (NONIPOL 400: produced by Sanyo Chemical Industries, Ltd.) and 10 parts by mass of anionic surfactant (NEOGEN SC: produced by Dai-ichi Kogyo Seiyaku Co., Ltd.) were added in place of colloidal silica. The properties of Resin particles 1 obtained are shown in Table 1.

TABLE 1

Production examples and properties of organic-inorganic composite fine particles, sol-gel silica, and resin particles

| | | | Inorganic fine particles 1 | | | Inorganic fine particles 2 | | | Properties | | | |
|---|---|---|---|---|---|---|---|---|---|---|---|---|
| | Vinyl based resin particles | | | | | | | | | | | |
| External additive species | Composition | Amount of resin (percent by mass) | Inorganic fine particle species | Amount of inorganic fine particles (percent by mass) | Inorganic fine particle diameter (nm) | Inorganic fine particle species | Amount of inorganic fine particles (percent by mass) | Inorganic fine particle diameter (nm) | Number average particle diameter (nm) | SF1 | SF2 | Abundance ratio of inorganic fine particles (%) |
| Organic-inorganic composite fine particles 1 | MPS | 34 | silica | 66 | 25 | — | — | — | 95 | 114 | 110 | 65 |
| Organic-inorganic composite fine particles 2 | MPS | 43 | silica | 57 | 25 | — | — | — | 109 | 118 | 112 | 54 |

TABLE 1-continued

Production examples and properties of organic-inorganic composite fine particles, sol-gel silica, and resin particles

| External additive species | Vinyl based resin particles | | Inorganic fine particles 1 | | | Inorganic fine particles 2 | | | Properties | | | |
|---|---|---|---|---|---|---|---|---|---|---|---|---|
| | Composition | Amount of resin (percent by mass) | Inorganic fine particle species | Amount of inorganic fine particles (percent by mass) | Inorganic fine particle diameter (nm) | Inorganic fine particle species | Amount of inorganic fine particles (percent by mass) | Inorganic fine particle diameter (nm) | Number average particle diameter (nm) | SF1 | SF2 | Abundance ratio of inorganic fine particles (%) |
| Organic - inorganic composite fine particles 3 | MPS | 47 | silica | 37 | 70 | silica | 16 | 15 | 130 | 135 | 118 | 50 |
| Organic-inorganic composite fine particles 4 | MPS | 55 | silica | 45 | 25 | — | — | — | 130 | 117 | 111 | 43 |
| Organic - inorganic composite fine particles 5 | MPS | 51 | silica | 49 | 25 | — | — | — | 143 | 115 | 109 | 48 |
| Organic - inorganic composite fine particles 6 | MPS | 47 | silica | 29 | 70 | silica | 24 | 15 | 150 | 138 | 119 | 46 |
| Organic-inorganic composite fine particles 7 | MPS | 54 | silica | 46 | 15 | — | — | — | 153 | 110 | 104 | 39 |
| Organic - inorganic composite fine particles 8 | MPS | 61 | silica | 39 | 50 | — | — | — | 250 | 130 | 115 | 30 |
| Organic-inorganic composite fine particles 9 | MPS | 50 | silica | 50 | 15 | — | — | — | 83 | 109 | 104 | 44 |
| Organic-inorganic composite fine particles 10 | MPS | 25 | silica | 75 | 15 | — | — | — | 53 | 108 | 102 | 71 |
| Organic-inorganic composite fine particles 11 | (melamine) | 82 | silica | 18 | 8 | — | — | — | 130 | 103 | 104 | 17 |
| Sol-gel silica particles | — | — | — | — | — | — | — | — | 110 | 101 | 102 | — |
| Resin particles | — | — | — | — | — | — | — | — | 100 | 102 | 102 | — |

MPS: methacryloxypropyl-trimethoxysilane

Second Inorganic Fine Particles

Inorganic fine particles described in Table 2 below were prepared as second inorganic fine particles.

TABLE 2

Properties of second inorganic fine particles

| External additive species | Number average particle diameter (nm) | BET specific surface area ($m^2/g$) | Surface treatment |
|---|---|---|---|
| Silica fine particles 1 | 23 | 57 | HMDS + oil treatment |
| Silica fine particles 2 | 31 | 32 | HMDS + oil treatment |
| Silica fine particles 3 | 8 | 147 | HMDS + oil treatment |
| Silica fine particles 4 | 28 | 70 | HMDS treatment |

Production Example of Toner Particles 1

After 710 parts of ion-exchanged water and 850 parts of 0.1-mol/L-$Na_3PO_4$ aqueous solution were added to a four-necked container, holding at 60° C. was performed while agitation was performed at 12,000 rpm by using a high-speed agitator TK-homomixer. Here, 68 parts of 1.0-mol/L-$CaCl_2$ aqueous solution was added gradually and, thereby, an aqueous dispersion medium containing fine sparingly water-soluble dispersion stabilizer $Ca_3(PO_4)_2$ was prepared.

| | |
|---|---|
| Styrene | 124 parts |
| n-Butyl acrylate | 36 parts |
| Copper phthalocyanine pigment (Pigment blue 15:3) | 13 parts |
| Styrene based resin (1) | 40 parts |
| Polyester based resin (1) (terephthalic acid-propylene oxide-modified bisphenol A (2 mole adduct) (molar ratio = 51:50), acid value = 10 mg KOH/g, glass transition point = 70° C., Mw = 10,500, Mw/Mn = 3.20) | 10 parts |
| Negative chargeability control agent (aluminum compound of 3,5-di-tert-butyl salicylic acid | 0.8 parts |
| Wax (Fischer-Tropsch wax, endothermic main peak temperature = 78° C.) | 15 parts |

The above-described materials were agitated for 3 hours by using an attritor to disperse the individual components into a polymerizable monomer, so that a monomer mixture was prepared. A polymerizable monomer composition was prepared by adding 20.0 parts of 1,1,3,3-tetramethylbutylperoxy-2-ethylhexanoate serving as a polymerization initiator (toluene solution 50%) to the monomer mixture. The polymerizable monomer composition was put into the aqueous dispersion medium, and granulation was performed for 5 minutes while the number of revolutions of the agitator was maintained at 10,000 rpm. Thereafter, the high-speed agitator was switched to a propeller agitator, the internal temperature was raised to 70° C., and a reaction was induced for 6 hours while agitation was performed slowly.

The temperature of the inside of the container was raised to 80° C. and was maintained for 4 hours. Subsequently, cooling to 30° C. was performed gradually at a cooling rate of 1° C. per minute, so that Slurry 1 was obtained. Dilute hydrochloric acid was added to the container including Slurry 1 to remove the dispersion stabilizer. Furthermore, filtration, cleaning, and drying were performed and, thereby, polymer particles (Toner base particles 1) having a weight average particle diameter (4) of 6.2 μm was obtained. The true density of Toner particles 1 was 1.1 $g/cm^3$.

Production Example of Toner Particles 2

Toner particles 2 were formed in the same manner as the manner of Toner particles 1 except that the temperature of the inside of the container was raised to 80° C. and was maintained for 4 hours and, furthermore, holding was performed at 110° C. for 1 hour. The true density of Toner particles 2 was 1.1 $g/cm^3$.

Production Example of Toner Particles 3

Production Example of Resin 1

The materials described below were weighed into a reaction vessel provided with a cooling tube, an agitator, and a nitrogen introduction tube.

| | |
|---|---|
| Terephthalic acid | 19.0 parts by mass |
| Polyoxyethylene(2,2)-2,2-bis(4-hydroxyphenyl)propane | 75.5 parts by mass |
| Titanium dihydoxybis(triethanolaminate) | 0.1 parts by mass |

Thereafter, heating to 220° C. was performed, and a reaction was induced for 10 hours while nitrogen was introduced and generated water was removed. Furthermore, 18.2 parts by mass of trimellitic anhydride was added, heating to 180° C. was performed, and a reaction was induced for 1.5 hours, so that Resin 1 was synthesized. As for the molecular weight determined with GPC of Resin 1, the weight average molecular weight (Mw) was 95,000, the number average molecular weight (Mn) was 6,500, and the peak molecular weight (Mp) was 13,000. The glass transition point was 60° C., and the softening point was 143° C.

Production Example of Resin 2

The materials described below were weighed into a reaction vessel provided with a cooling tube, an agitator, and a nitrogen introduction tube.

| | |
|---|---|
| Terephthalic acid | 23.0 parts by mass |
| Trimellitic anhydride | 1.5 parts by mass |
| Polyoxypropylene(2,2)-2,2-bis(4-hydroxyphenyl)propane | 76.0 parts by mass |
| Titanium dihydoxybis(triethanolaminate) | 0.1 parts by mass |

Thereafter, heating to 200° C. was performed, and a reaction was induced for 9 hours while nitrogen was introduced and generated water was removed. Subsequently, decompression to 10 mmHg was performed, and a reaction was induced for 1 hour, so that Resin 2 was synthesized. As for the molecular weight determined with GPC of Resin 2, the weight average molecular weight (Mw) was 6,300, the number average molecular weight (Mn) was 2,500, and the peak molecular weight (Mp) was 2,800. The glass transition point was 55° C., and the softening point was 93° C.

The materials described below were mixed sufficiently with a Henschel mixer (Model FM-75, produced by Mitsui Miike Chemical Engineering Machinery Co., Ltd.). Subsequently, kneading was performed with a twin screw extruder (Model PCM-30, produced by Ikegai Corporation) set at a temperature of 130° C.

| | |
|---|---|
| Resin 1 described above | 50.0 parts by mass |
| Resin 2 described above | 50.0 parts by mass |
| Wax (Fischer-Tropsch wax, DSC maximum endothermic peak 100° C.) | 10.0 parts by mass |
| C.I. Pigment Blue 15:3 | 5.0 parts by mass |

The resulting kneaded material was cooled and was coarsely crushed to 1 mm or less with a hammer mill to obtain coarsely crushed material. The resulting coarsely crushed material was pulverized with a collision type air flow pulverizer by using a high pressure gas.

The resulting pulverized material was subjected to surface modification with Meteorainbow (produced by Nippon Pneumatic Manufacturing Co., Ltd.). As for the surface modification condition, the raw material feed rate was 2.0 kg/hr, the hot air flow rate was 4.5 $m^3$/min, the hot air discharge temperature was 220° C., the cold air temperature was 3° C., and the cold air flow rate was 3.0 $m^3$/min. Then, classification was performed with an air classifier (Elbow Jet Labo EJ-L3, produced by Nittetsu Mining Co., Ltd.) through the use of a Coanda effect and, thereby, Toner particles 3 was obtained by classifying and removing a fine powder and a coarse powder at the same time. The true density of Toner particles 3 was 1.1 g/$cm^3$.

Production Example of Photosensitive Drum

Synthesis Example of Polyester Resin A

The polyester resin A may be synthesized by using the synthesis method described in PTL 5. In the present invention as well, the same synthesis method was used, and the polyester resin A shown in the synthesis example in Table 3 was synthesized by using raw materials in accordance with the repeated structure unit represented by the formula (A) and the repeated structure unit represented by the formula (B). The configuration and the weight average molecular weight of the resulting polyester resin A are shown in Table 3.

TABLE 3

| Polyester resin A | Formula (A) Structure unit | Formula (A) Average value of n | Formula (B) | Formula (C) | Content of formula (A) | Content of formula (B) | Weight average molecular weight |
|---|---|---|---|---|---|---|---|
| Resin A(1) | (A-2)/(A-6) = 5/5 | 40 | (B-1)/(B-2) = 5/5 | — | 20 | 80 | 110,000 |

An aluminum cylinder having a diameter of 24 mm and a length of 257 mm was used as a support (electrically conductive support) of the photosensitive drum.

Next, a coating liquid for electrically conductive layer was prepared by using 10 parts of $SnO_2$ coat-treated barium particles (electrically conductive particles), 2 parts of titanium oxide particles (pigment for controlling resistance), 6 parts of phenol resin, 0.001 parts of silicone oil (leveling agent), and a mixed solvent of methanol 4 parts/methoxypropanol 16 parts.

The resulting coating liquid for electrically conductive layer was applied to the support by soaking, and curing (thermosetting) was performed at 140° C. for 30 minutes to form an electrically conductive layer having a thickness of 15 μm.

A coating liquid for undercoating layer was prepared by dissolving 3 parts of N-methoxymethylated nylon and 3 parts of copolymerized nylon into a mixed solvent of methanol 65 parts/n-butanol 30 parts.

The resulting coating liquid for undercoating layer was applied to the electrically conductive layer by soaking, and drying was performed at 100° C. for 10 minutes to form an undercoating layer having a thickness of 0.7 μm.

Subsequently, 10 parts of hydroxygallium phthalocyanine (charge generation substance) with a crystal form exhibiting intense peaks at 7.5°, 9.9°, 16.3°, 18.6°, 25.1°, and 28.3° which were Bragg angle 2θ±0.2° in CuKα characteristic X-ray diffraction was prepared. This was mixed with 250 parts of cyclohexanone and 5 parts of polyvinylbutyral resin (trade name: S-LEC BX-1, produced by Sekisui Chemical Co., Ltd.), and dispersion was performed for 1 hour in an atmosphere at 23±3° C. with a sand mill apparatus by using glass beads having a diameter of 1 mm. After dispersion, a coating liquid for charge generation layer was prepared by adding 250 parts of ethyl acetate. The resulting coating liquid for charge generation layer was applied to the undercoating layer by soaking, and the resulting coating film was dried at 100° C. for 10 minutes to form a charge generation layer having a thickness of 0.26 μm.

A coating liquid for charge transport layer was prepared by dissolving 9 parts of compound represented by the formula (E-1) (charge transport substance), 1 part of compound represented by the formula (E-2) (charge transport substance), 3 parts of Resin A (1) synthesized in Synthesis example 1, and 7 parts of polycarbonate resin (D-1) having a weight average molecular weight of 140,000 into a mixed solvent of 30 parts of dimethoxymethane and 50 parts of o-xylene.

The resulting coating liquid for charge transport layer was applied to the charge generation layer by soaking, and the resulting coating film was dried at 120° C. for 1 hour to form a charge transport layer having a thickness of 16 μm. It was ascertained that in the resulting charge transport layer, a domain structure containing the polyester resin A was included in a matrix containing the charge transport substance and the polycarbonate resin (D). This was specified to be Photosensitive drum 1 and the constituent materials of the photosensitive drum are shown in Table 4.

TABLE 4

| | Charge transport substance | Polyester resin A | Polycarbonate resin D | Mixing ratio |
|---|---|---|---|---|
| Photosensitive drum 1 | (E-1)/(E-2) = 9/1 | Resin A (1) | D-1 | 3/7 |

Example 1

Toner 1 was obtained by externally adding the external additives described in Table 1 and Table 2 relative to the resulting Toner particles 1 (100 parts) with NOBILTA (produced by Hosokawa Micron Corporation) for 5 minutes at a power of 0.5 kW.

The prescription and the properties of Toner 1 are as described in Table 5.

The following evaluation tests were performed by using the resulting toners. The evaluation results are shown in Table 6.

Evaluation Test

A laser beam printer LBP-5050 produced by CANON KABUSHIKI KAISHA was used for the evaluation after the contact linear pressure of the cleaning blade was modified to 0.3 N/cm and the contact angle was modified to 23 degrees. A4 sized normal paper was used as the evaluation paper. The examination was performed under a severe condition with respect to the cleanability, whereas the contact linear pressure of the previously known spherical toner was set at 1.0 N/cm or more.

As for the evaluation of the cleanability, the evaluation was performed in a low-temperature low-humidity environment because if the hardness of the cleaning blade increased, the ability to track the photosensitive drum was degraded. The charge member contamination was evaluated in a low-temperature low-humidity environment because if the voltage applied to the contact charge member increased, image defects occurred easily. The fog, the image density stability, and the thin line reproducibility were evaluated in a high-temperature high-humidity environment because the toner was degraded by the influence of heat and humidity easily.

Toner Cleanability

The cleaning performance was evaluated by performing an endurance test in which 3,000 sheets of ruled line images with a coverage of 5% were output continuously in a low-temperature low-humidity environment (10° C./14% Rh).

A: No poor cleaning is observed on the paper and the roller is not contaminated by the toner.

B: No poor cleaning is observed on the paper, but the roller is contaminated by the toner.

C: After at least 50 sheets are printed out, a vertical streak resulting from poor cleaning is observed on the paper.

D: After 49 or less of sheets are printed out, a vertical streak resulting from poor cleaning is observed on the paper.

Photo Conductor Flaw

An endurance test was performed, in which 3,000 sheets of ruled line images with a coverage of 5% were output continuously in a low-temperature low-humidity environment (10° C./14% Rh). The state of flaw on the surface of the photo conductor was evaluated on the basis of the 10-point average roughness Rz measured with a surface roughness meter and the result of flaw observation.

A: The rate of Rz change is less than 20% (deep flaw is not present and no influence is observed in the output image).

B: The rate of Rz change is 20% or more, and there is no flaw of 1 μm or more (the image is hardly influenced).

C: A deep flaw of 1 μm or more and less than 2 μm occurs (the image is influenced slightly).

D: A deep flaw of 2 μm or more occurs (an influence of the flaw is observed in the output image).

Charge Member Contamination

An endurance test was performed, in which 1,000 sheets of images with a coverage of 20% were output continuously in a low-temperature low-humidity environment (10° C./14% Rh). Contamination of the charge roller due to the external additive was visually examined at 100th sheet, 500th sheet, and 1,000th sheet, and charge member contamination was evaluated by outputting a half tone image.

A: Up to 1,000 sheets, there is no charge roller contamination problem.

B: Up to 500 sheets, there is no charge roller contamination problem.

C: Up to 100 sheets, there is no charge roller contamination problem.

D: An image defect resulting from charge roller contamination occurs at 100th sheet.

Evaluation of Fog

An operation, in which an image with a coverage of 1% was output in a high-temperature high-humidity environment (32.5° C./90% Rh), was repeated, and every time the number of output sheets reached 200, standing for a night in each environment was executed. Subsequently, the step to output 200 sheets and stand for a night, as described above, was repeated. Finally, 2,000 sheets of images were output and evaluation was performed in the method described below.

In the above-described image output test, a sheet of image having a white background portion was output every time. Then, the fog densities (%) (=Dr (%)−Ds (%)) of all images having a white background portion were calculated from the difference between the degree of whiteness (reflectivity Ds (%)) of the white background portion of the image having a white background portion and the degree of whiteness of the transfer paper (average reflectivity Dr (%)). In this regard, the degree of whiteness was measured with "REFLECTMETER MODEL TC-6DS" (produced by Tokyo Denshoku Co., Ltd.). Amberlite filter was used as the filter. Ranking was performed as described below on the basis of the worst fog.

A: The fog density is less than 0.3%.

B: The fog density is 0.3% or more and less than 0.8%.

C: The fog density is 0.8% or more and less than 1.3%.

D: The fog density is 1.3% or more.

Image Density Stability

In the same image output test as that of the above-described fog evaluation, a sheet of solid image was output every time, and the density of each image was measured. Among the resulting image densities, the difference between the maximum density and the minimum density was determined and was shown on the basis of the evaluation criteria described below. The image density was measured with a color reflectivity densitometer (X-RITE 404 produced by X-Rite, Inc.).

A: The image density difference is 0.1 or less.

B: The image density difference is more than 0.1 and 0.3 or less.

C: The image density difference is more than 0.3 and 0.5 or less.

D: The image density difference is more than 0.5. An image streak resulting from a streak of a development sleeve occurs on the image.

Thin Line Reproducibility

The thin line reproducibility was evaluated from the viewpoint of the image quality. In the above-described image output, after 2,000 sheets of images were output, an image of a lattice pattern with a line width of 3 pixels was printed on all over the A4 sized paper (coverage 4% on an area basis), and the thin line reproducibility was evaluated on the basis of the evaluation criteria described below. The line width of 3 pixels was 127 μm theoretically. The line width of the image was measured with Microscope VK-8500 (produced by KEYENCE CORPORATION). Randomly selected 5 line widths were measured, the average value of 3 points excluding the minimum value and the maximum value was specified to be d (μm), and the thin line reproducibility index L was defined as described below.

$$L\ (\mu m) = |127 - d|$$

The difference between the theoretical line width 127 μm and the line width d on the output image was defined as L. The absolute value of the difference is employed in the definition because d may be larger than 127 or be smaller than 127. A smaller L indicates excellent thin line reproducibility.

A: L is 0 μm or more and less than 5 μm.

B: L is 5 μm or more and less than 15 μm and slight variations are observed in the width of the thin line.

C: L is 15 μm or more and less than 30 μm and thinning or scattering of the thin line is noticeable.

D: L is 30 μm or more and breakage or thickening of the thin line is observed in places.

Examples 2 to 16

Toners 2 to 16 were obtained in the same manner as the manner in Example 1 except that the prescription described in Table 5 was employed. The properties of the toners are as shown in Table 5.

The results of evaluation performed as that in Example 1 are shown in Table 6.

Comparative Examples 1 to 5

Toners 17 to 21 were obtained in the same manner as the manner in Example 1 except that the prescription described in Table 5 was employed. The properties of the toners are as shown in Table 5.

The results of evaluation performed as that in Example 1 are shown in Table 6.

TABLE 5

| Production examples and properties of toner | | | | | | | | |
|---|---|---|---|---|---|---|---|---|
| | | | External additive prescription | | | | | |
| | Toner particles | | | | | | | |
| | Type | Average circularity | First external additive species | Amount of addition of first external additive (parts by mass) | Number average particle diameter of first external additive species (nm) | SF1 of first external additive species | SF2 of first external additive species | Content of first external additive (parts by mass) |
| Toner 1 | Toner particles 1 | 0.980 | Organic-inorganic composite fine particles 1 | 3.0 | 95 | 114 | 110 | 2.8 |
| Toner 2 | Toner particles 1 | 0.980 | Organic-inorganic composite fine particles 2 | 3.0 | 109 | 111 | 105 | 2.8 |
| Toner 3 | Toner particles 1 | 0.980 | Organic-inorganic composite fine particles 3 | 3.0 | 130 | 110 | 125 | 2.8 |
| Toner 4 | Toner particles 1 | 0.980 | Organic-inorganic composite fine particles 4 | 3.0 | 130 | 113 | 106 | 2.8 |
| Toner 5 | Toner particles 1 | 0.980 | Organic-inorganic composite fine particles 5 | 3.0 | 143 | 109 | 105 | 2.8 |
| Toner 6 | Toner particles 1 | 0.980 | Organic-inorganic composite fine particles 6 | 3.0 | 150 | 115 | 128 | 2.8 |
| Toner 7 | Toner particles 1 | 0.980 | Organic-inorganic composite fine particles 7 | 3.0 | 153 | 121 | 102 | 2.8 |
| Toner 8 | Toner particles 1 | 0.980 | Organic-inorganic composite fine particles 8 | 3.0 | 250 | 110 | 120 | 2.8 |
| Toner 9 | Toner particles 1 | 0.980 | Organic-inorganic composite fine particles 9 | 3.0 | 83 | 121 | 102 | 2.8 |
| Toner 10 | Toner particles 1 | 0.980 | Organic-inorganic composite fine particles 9 | 3.0 | 82 | 120 | 101 | 2.8 |
| Toner 11 | Toner particles 1 | 0.980 | Organic-inorganic composite fine particles 7 | 3.0 | 155 | 120 | 101 | 2.8 |
| Toner 12 | Toner particles 1 | 0.980 | Organic-inorganic composite fine particles 9 | 3.0 | 84 | 119 | 100 | 2.8 |
| Toner 13 | Toner particles 2 | 0.972 | Organic-inorganic composite fine particles 9 | 3.0 | 82 | 120 | 102 | 2.8 |
| Toner 14 | Toner particles 3 | 0.963 | Organic-inorganic composite fine particles 9 | 3.0 | 84 | 121 | 101 | 2.8 |
| Toner 15 | Toner particles 1 | 0.980 | Organic-inorganic composite fine particles 8 | 0.5 | 252 | 108 | 118 | 0.5 |
| Toner 16 | Toner particles 1 | 0.980 | Organic-inorganic composite fine particles 7 | 5.0 | 150 | 120 | 101 | 4.7 |
| Toner 17 | Toner particles 1 | 0.980 | Organic-inorganic composite fine particles 10 | 3.0 | 53 | 118 | 101 | 2.8 |
| Toner 18 | Toner particles 1 | 0.980 | Organic-inorganic composite fine particles 11 | 3.0 | 130 | 103 | 104 | 2.8 |
| Toner 19 | Toner particles 1 | 0.980 | Sol-gel silica | 3.0 | 110 | 101 | 102 | 2.8 |
| Toner 20 | Toner particles 1 | 0.980 | Fluorine-acrylic resin particles | 3.0 | 100 | 102 | 102 | 2.8 |
| Toner 21 | Toner particles 1 | 0.980 | — | — | — | — | — | — |

TABLE 5-continued

| Production examples and properties of toner | | | | | | | |
|---|---|---|---|---|---|---|---|
| | External additive prescription | | | | | | |
| | Second external additive species | Amount of addition of second external additive (parts by mass) | Content of second external additive (parts by mass) | External addition condition | $F/Q^2$ | Toner adhesion at 4,000 $(mC/kg)^2$ | Ratio of number average particle diameter (A) to number average particle diameter (B) (A/B) |
| Toner 1 | Silica fine particles 1 | 0.5 | 0.4 | 0.5 kw/ 5 min | 0.021 | 150 | 4.1 |
| Toner 2 | Silica fine particles 1 | 0.5 | 0.4 | 0.5 kw/ 5 min | 0.025 | 123 | 4.7 |
| Toner 3 | Silica fine particles 1 | 0.5 | 0.4 | 0.5 kw/ 5 min | 0.018 | 114 | 5.7 |
| Toner 4 | Silica fine particles 1 | 0.5 | 0.4 | 0.5 kw/ 5 min | 0.031 | 94 | 5.7 |
| Toner 5 | Silica fine particles 1 | 0.5 | 0.4 | 0.5 kw/ 5 min | 0.037 | 105 | 6.2 |
| Toner 6 | Silica fine particles 1 | 0.5 | 0.4 | 0.5 kw/ 5 min | 0.009 | 106 | 6.5 |
| Toner 7 | Silica fine particles 1 | 0.5 | 0.4 | 0.5 kw/ 5 min | 0.036 | 72 | 6.7 |
| Toner 8 | Silica fine particles 1 | 0.5 | 0.4 | 0.5 kw/ 5 min | 0.015 | 60 | 10.9 |
| Toner 9 | Silica fine particles 1 | 0.5 | 0.4 | 0.5 kw/ 5 min | 0.015 | 180 | 3.6 |
| Toner 10 | Silica fine particles 2 | 0.5 | 0.4 | 0.5 kw/ 5 min | 0.018 | 155 | 2.7 |
| Toner 11 | Silica fine particles 3 | 0.5 | 0.4 | 0.5 kw/ 5 min | 0.024 | 106 | 19.1 |
| Toner 12 | Silica fine particles 4 | 0.5 | 0.4 | 0.5 kw/ 5 min | 0.013 | 165 | 3.0 |
| Toner 13 | Silica fine particles 1 | 0.5 | 0.4 | 0.5 kw/ 5 min | 0.021 | 175 | 3.6 |
| Toner 14 | Silica fine particles 1 | 0.5 | 0.4 | 0.5 kw/ 5 min | 0.015 | 180 | 3.6 |
| Toner 15 | Silica fine particles 1 | 0.5 | 0.4 | 0.5 kw/ 5 min | 0.038 | 120 | 10.9 |
| Toner 16 | Silica fine particles 1 | 0.5 | 0.4 | 1.5 kw/ 5 min | 0.023 | 134 | 6.7 |
| Toner 17 | Silica fine particles 1 | 0.5 | 0.4 | 0.5 kw/ 5 min | 0.050 | 115 | 1.7 |
| Toner 18 | Silica fine particles 1 | 0.5 | 0.4 | 0.5 kw/ 5 min | 0.038 | 75 | 4.2 |
| Toner 19 | Silica fine particles 1 | 0.5 | 0.4 | 0.5 kw/ 5 min | 0.055 | 126 | 3.5 |
| Toner 20 | Silica fine particles 1 | 0.5 | 0.4 | 0.5 kw/ 5 min | 0.052 | 119 | 3.2 |
| Toner 21 | Silica fine particles 1 | 1.5 | 1.3 | 1.5 kw/ 5 min | 0.028 | 134 | — |

TABLE 6

| Evaluation result | | | | | | | |
|---|---|---|---|---|---|---|---|
| | Toner species | Cleanability | Photo conductor flaw | Charge member contamination | Fog | Image density stability | Thin line reproducibility |
| Example 1 | Toner 1 | B | A (15%) | A | A (0.1) | A (0.1) | A (3 μm) |
| Example 2 | Toner 2 | A | A (13%) | A | A (0.1) | A (0.1) | A (2 μm) |
| Example 3 | Toner 3 | A | A (12%) | A | A (0.1) | A (0.1) | A (2 μm) |
| Example 4 | Toner 4 | A | A (11%) | A | A (0.1) | A (0.1) | A (2 μm) |
| Example 5 | Toner 5 | B | A (18%) | A | A (0.1) | A (0.1) | A (3 μm) |
| Example 6 | Toner 6 | A | A (19%) | B (occur at 700th sheet) | A (0.2) | B (0.2) | B (7 μm) |

TABLE 6-continued

| | Toner species | Cleanability | Photo conductor flaw | Charge member contamination | Fog | Image density stability | Thin line reproducibility |
|---|---|---|---|---|---|---|---|
| | | Evaluation result | | | | | |
| Example 7 | Toner 7 | C (occur at 200th sheet) | A (17%) | B (occur at 700th sheet) | A (0.1) | A (0.1) | A (2 μm) |
| Example 8 | Toner 8 | A | A (16%) | B (occur at 600th sheet) | A (0.2) | C (0.4) | B (10 μm) |
| Example 9 | Toner 9 | C (occur at 400th sheet) | A (17%) | B (occur at 800th sheet) | A (0.1) | A (0.1) | A (3 μm) |
| Example 10 | Toner 10 | C (occur at 300th sheet) | A (18%) | B (occur at 800th sheet) | A (0.2) | C (0.5) | A (4 μm) |
| Example 11 | Toner 11 | C (occur at 800th sheet) | A (16%) | A | A (0.2) | A (0.1) | C (18 μm) |
| Example 12 | Toner 12 | C (occur at 400th sheet) | A (18%) | B (occur at 800th sheet) | A (0.2) | B (0.3) | A (4 μm) |
| Example 13 | Toner 13 | B | A (16%) | B (occur at 800th sheet) | A (0.2) | A (0.1) | B (12 μm) |
| Example 14 | Toner 14 | A | A (17%) | B (occur at 800th sheet) | A (0.1) | A (0.1) | C (18 μm) |
| Example 15 | Toner 15 | B | A (18%) | A | A (0.2) | B (0.2) | C (20 μm) |
| Example 16 | Toner 16 | B | A (19%) | B (occur at 600th sheet) | A (0.1) | C (0.4) | A (4 μm) |
| Comparative example 1 | Toner 17 | D (occur at 40th sheet) | A (17%) | A | A (0.1) | A (0.1) | A (3 μm) |
| Comparative example 2 | Toner 18 | A | A (15%) | D | D (1.0) | D (0.6) | A (2 μm) |
| Comparative example 3 | Toner 19 | B | A (19%) | D | A (0.2) | A (0.1) | A (4 μm) |
| Comparative example 4 | Toner 20 | B | A (12%) | D | A (0.2) | A (0.1) | A (3 μm) |
| Comparative example 5 | Toner 21 | D (occur at 10th sheet) | A (9%) | A | A (0.1) | B (0.2) | C (23 μm) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-159302, filed Jul. 31, 2013, which is hereby incorporated by reference herein in its entirety.

The invention claimed is:

1. A toner comprising:

toner particles containing a binder resin; and organic-inorganic composite fine particles, each of which comprises a vinyl based resin particle and inorganic fine particles, wherein:

the binder resin comprises a vinyl based polymer or a polyester, the inorganic fine particles are exposed at surfaces of the organic-inorganic composite fine particles, each of the organic-inorganic composite fine particles has convex portions derived from the inorganic fine particles on the surfaces thereof, and an abundance ratio of the inorganic fine particles exposed at the surface of the organic-inorganic fine particles ranges from 20% to 70%, and wherein:

the toner has an average circularity of 0.960 or more, wherein when the toner is charged by a two-component method so as to have a squared triboelectricity ($Q^2$) of 4000 $(mC/kg)^2$, the toner has an electrostatic adhesion F to a polycarbonate flat plate of 50 to 200 nN, and a gradient of a linear approximation straight line ranges from 0.003 to 0.040, wherein the linear approximation straight line is obtained by a process including:

preparing three sets of the toner each having different squared triboelectricity from each other, measuring electrostatic adhesion to a polycarbonate flat plate of the respective sets of the toner, plotting the measured electrostatic adhesion on a graph having a horizontal axis of squared triboelectricity $Q^2$ ($(mC/kg)^2$), and a vertical axis of electrostatic adhesion F (nN) to a polycarbonate flat plate, and drawing the liner approximation straight line based on the plots on the graph.

2. The toner according to claim 1, wherein the content of the organic-inorganic composite fine particles is 0.5 parts by mass or more and 5.0 parts by mass or less relative to 100 parts by mass of the toner particles.

3. The toner according to claim 1, wherein the organic-inorganic composite fine particles have the shape factor SF-1 of 100 or more and 150 or less and the shape factor SF-2 of 103 or more and 120 or less, which are measured by using a magnified image of the organic-inorganic composite fine particles photographed with a scanning electron microscope.

4. The toner according to claim 1, wherein the number average particle diameter of the organic-inorganic composite fine particles is 50 nm or more and 400 nm or less.

5. The toner according to claim 1, further comprising second inorganic fine particles on the toner particle surfaces in addition to the organic-inorganic composite fine particles, wherein $50 \leq A \leq 400$ and $1.5 \leq A/B \leq 10.0$ are satisfied, where the number average particle diameter of the organic-inorganic composite fine particles is specified to be A (nm) and the number average particle diameter of the second inorganic fine particles is specified to be B (nm).

6. An image forming method comprising the steps of:

charging an image bearing member in a charging step;

forming an electrostatic latent image on the charged image bearing member in a latent image formation step;

developing the electrostatic latent image by using a toner to form a toner image in a development step;

transferring the toner image to a transfer material in a transfer step; and fixing the toner image to the transfer material in a fixing step, wherein the toner is the toner according to claim 1, the image bearing member includes a support, a charge generation layer disposed on the support, and a charge transport layer disposed on the charge generation layer and the charge transport layer is an electrophotographic photo conductor serving as a surface layer, the charge transport layer has a matrix-domain structure composed of a matrix and a domain, the domain contains a polyester resin A having a repeated structure unit represented by the following formula (A) and a repeated structure unit represented by the following formula (B), the matrix contains at least one resin selected from the group consisting of a polyester resin C having a repeated structure unit represented by the following formula (C) and a polycarbonate resin D having a repeated structure unit represented by the following formula (D) and a charge transport substance, the content of the repeated structure unit represented by the following formula (A) is 10 percent by mass or more and 40 percent by mass or less relative to the total mass of the polyester resin A, and the content of the repeated structure unit represented by the following formula (B) is 60 percent by mass or more and 90 percent by mass or less relative to the total mass of the polyester resin A,

[Chem. 1]

(A)

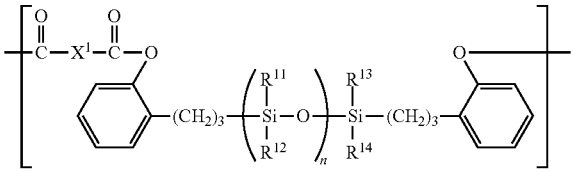

(in the formula (A), $X^1$ represents a m-phenylene group, a p-phenylene group, or a divalent group in which two p-phenylene groups are bonded with an oxygen atom therebetween, $R^{11}$ to $R^{14}$ represent independently a methyl group, an ethyl group, or a phenyl group, n represents the number of repetition of the unit in the parentheses, and an average value of n in the polyester resin A is 20 or more and 120 or less),

[Chem. 2]

(B)

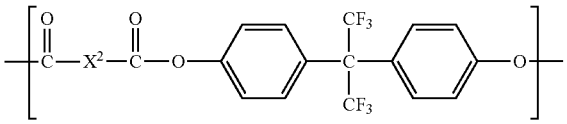

(in the formula (B), $X^2$ represents a m-phenylene group, a p-phenylene group, or a divalent group in which two p-phenylene groups are bonded with an oxygen atom therebetween)

[Chem. 3]

(C)

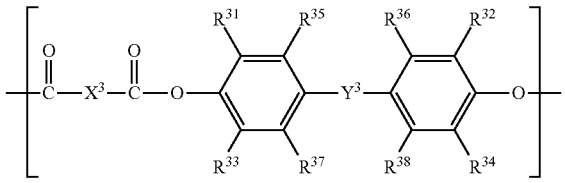

(in the formula (C), $R^{31}$ to $R^{38}$ represent independently a hydrogen atom or a methyl group, $X^3$ represents a m-phenylene group, a p-phenylene group, or a divalent group in which two p-phenylene groups are bonded with an oxygen atom therebetween, and $Y^3$ represents a single bond, a methylene group, an ethylidene group, or a propylidene group), and

[Chem. 4]

(D)

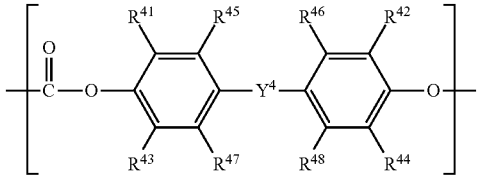

(in the formula (D), $R^{41}$ to $R^{48}$ represent independently a hydrogen atom or a methyl group, and $Y^4$ represents a methylene group, an ethylidene group, a propylidene group, a phenylethylidene group, a cyclohexylidene group, or an oxygen atom).

7. The toner according to claim 6, wherein the number average particle diameter B of the second inorganic fine particles is 5 nm or more and 50 nm or less.

8. The toner according to claim 5, wherein the second inorganic fine particles comprise silica fine particles which is subjected to a silicone oil treatment.

9. The toner according to claim 1, wherein the toner has an average circularity of 0.970 or more.

* * * * *